US012096807B2

(12) United States Patent
Choudhury et al.

(10) Patent No.: US 12,096,807 B2
(45) Date of Patent: Sep. 24, 2024

(54) CONFIGURABLE SUPPORT BRA

(71) Applicants: Sambhu N. Choudhury, Cincinnati, OH (US); Arturo David Sanchez, Lebanon, OH (US); Monika Rathnayake, Cincinnati, OH (US)

(72) Inventors: Sambhu N. Choudhury, Cincinnati, OH (US); Arturo David Sanchez, Lebanon, OH (US); Monika Rathnayake, Cincinnati, OH (US)

( * ) Notice: Subject to any disclaimer, the term of this patent is extended or adjusted under 35 U.S.C. 154(b) by 384 days.

(21) Appl. No.: 17/116,417

(22) Filed: Dec. 9, 2020

(65) Prior Publication Data

US 2021/0169152 A1 Jun. 10, 2021

Related U.S. Application Data

(60) Provisional application No. 62/946,383, filed on Dec. 10, 2019.

(51) Int. Cl.
*A41C 3/00* (2006.01)
*A41F 9/00* (2006.01)
*A41F 15/00* (2006.01)

(52) U.S. Cl.
CPC ..... *A41C 3/0028* (2013.01); *A41F 15/002* (2013.01)

(58) Field of Classification Search
CPC ..... A41C 3/00; A41C 3/0028; A41C 3/0021; A41C 3/005; A41F 15/00; A41F 15/002; A61H 19/00; A45F 3/045; A45F 3/12; A45F 3/14
USPC ..... 450/86, 1, 2, 7, 155, 147, 141, 111, 113; 2/48, 104, 230, 255, 259, 264
See application file for complete search history.

(56) References Cited

U.S. PATENT DOCUMENTS 2,523,715 A * 9/1950 Panes ..... A41C 3/00 D2/709
2,664,564 A * 1/1954 Finkelstein ..... A41C 3/00 450/59
2,773,261 A * 12/1956 Schaumer ..... A41C 3/00 450/86
10,856,586 B2 * 12/2020 Hirakubo ..... A41C 3/142
2010/0120329 A1 * 5/2010 MacDonald ..... A41C 3/0021 450/86
2014/0349550 A1 * 11/2014 Campbell ..... A41C 3/0021 450/60
2015/0004877 A1 1/2015 Bailey et al.
(Continued)

FOREIGN PATENT DOCUMENTS

CN 108371357 A * 8/2018 ..... A41C 3/0028

OTHER PUBLICATIONS

CN108371357A_Google_English, Google translation of Chinese patent application publication (Year: 2018).*

*Primary Examiner* — Khoa D Huynh
*Assistant Examiner* — Erick I Lopez
(74) *Attorney, Agent, or Firm* — Jenei LLC

(57) ABSTRACT

A configurable bra provides additional support and comfort to accommodate a wide variation in breast shapes and weights. The variations can arise from factors such as: (i) asymmetry; (ii) mastectomy; (iii) period changes; (iv) maternity changes; (v) breast feeding; and (vi) orthopedic inputs (e.g., weight distribution, center of gravity change, volume shift, etc.). In one or more embodiments, adjustments for circumference and amount of vertical lifting of the breasts is provided to handle different women or changes that occur for the same woman.

2 Claims, 18 Drawing Sheets

(56) References Cited

U.S. PATENT DOCUMENTS

| | | | | |
|---|---|---|---|---|
| 2015/0264982 | A1 | 9/2015 | Randall et al. | |
| 2016/0021938 | A1 | 1/2016 | Carpenter | |
| 2016/0135513 | A1* | 5/2016 | Solotoff | A41C 3/0007 450/63 |
| 2018/0343928 | A1 | 12/2018 | Morrow | |
| 2019/0021406 | A1 | 1/2019 | Funk-Danielson et al. | |
| 2019/0116891 | A1* | 4/2019 | Wisniewski | A41C 3/0092 |
| 2020/0037673 | A1* | 2/2020 | Storelli | A41C 3/0057 |

* cited by examiner

CONFIGURABLE SUPPORT BRA

CROSS-REFERENCE TO RELATED APPLICATIONS

This application claims the benefit of priority under 35 U.S.C. § 119(e) to U.S. Patent Application Provisional Application Ser. No. 62/946,383, entitled "CONFIGURABLE BRA", filed Dec. 10, 2019, the contents of which are hereby incorporated by reference in their entirety for any purpose.

BACKGROUND

1. Technical Field

The present disclosure generally relates to undergarments, and more specifically to a woman's brassiere ("bra").

2. Description of the Related Art

Women's undergarment brassieres ("bras") that often do not comfortably support the breasts due to factors such as high cantilever forces, delicate skin, etc., causing back pain and abrasions under shoulder straps and cups of the bra. This discomfort increases in proportion to a growing obesity epidemic that results in increased cup size with corresponding additional cantilevered forces.

Conventional bras may provide support through the use of underwires made of metals or hard plastics. Providing support by using underwires has a number of drawbacks. For instance, they can cause discomfort by pressing uncomfortably into the wearer's flesh. In addition, because typical underwires are made of metal or hard plastic, they are generally affixed to the bra by encasing the underwire between layers of bra material. The user of multiple layers of bra material not only adds to manufacturing costs and waste but also adds bulk and weight to the bra. Furthermore, the tip of the underwire may penetrate one or more of the layers and cause chaffing or other discomfort to the wearer. Traditional underwires, moreover, fail to flex and bend with the wearer again causing discomfort and limiting the wearer's range of movement.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
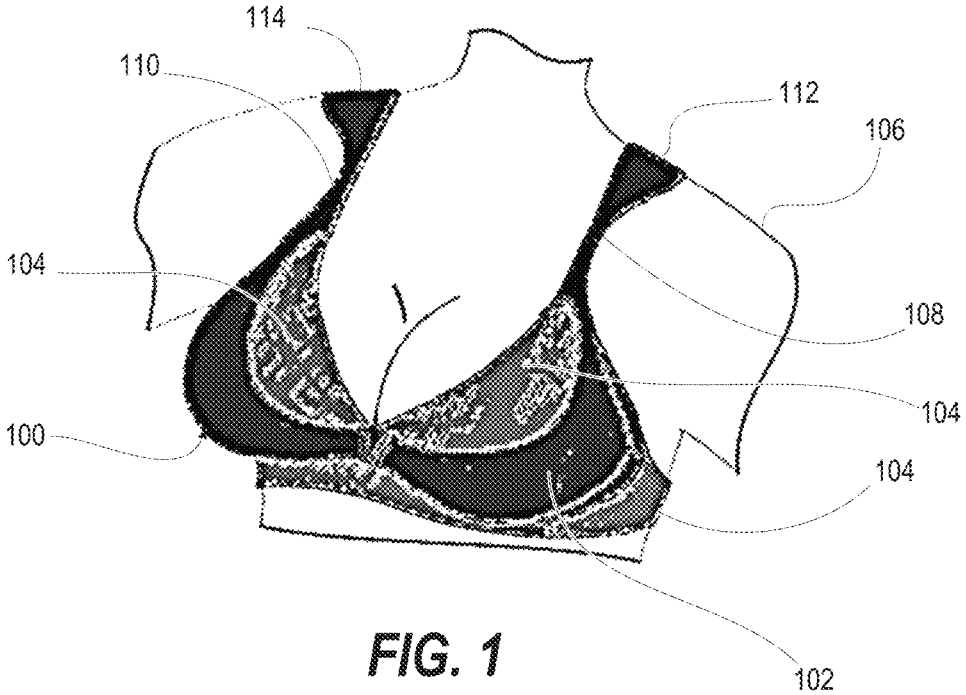
FIG. 1 is a front view of an example bra having support and comfort portions and worn on a female upper torso, according to one or more embodiments.

According to aspects of the present disclosure, a configurable bra provides additional support and comfort to accommodate a wide variation in breast shapes and weights. The variations can arise from factors such as: (i) asymmetry; (ii) mastectomy; (iii) period changes; (iv) maternity changes; (v) breast feeding; and (vi) orthopedic inputs (e.g., weight distribution, center of gravity change, volume shift, etc.). In one or more embodiments, adjustments for circumference and amount of vertical lifting of the breasts is provided to handle different women or changes that occur for the same woman.

In the following detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements.

In one illustrative aspect, the bra of the present invention comprises a front portion having at least a pair of breast cups, a pair of shoulder straps, and a front underband segment located under the breast cups. As used throughout this disclosure, the term "breast cups" is meant to signify a general region of the bra that covers the wearer's breasts. The term "cup" is not meant to be limited to an actual cup-like structure as that term is used within the art, although cup-like structures are within the scope of the aspects discussed herein. Further, the pair of breast cups may comprise a single piece of material that covers both of the wearer's breasts and lacks a clear demarcation between the right breast region and the left breast region. In another example, the pair of breast cups may comprise a piece of material that primarily covers the right breast region and a piece of material that primarily covers the left breast region with a more defined demarcation between the two regions. Any and all such aspects, and any variation thereof, are contemplated as being within the scope herein. Further, as used throughout this disclosure, the term "underband" is meant to generally denote the lower or inferior portion of the bra when worn and may encompass the lower margin of the bra.

Figure 2:
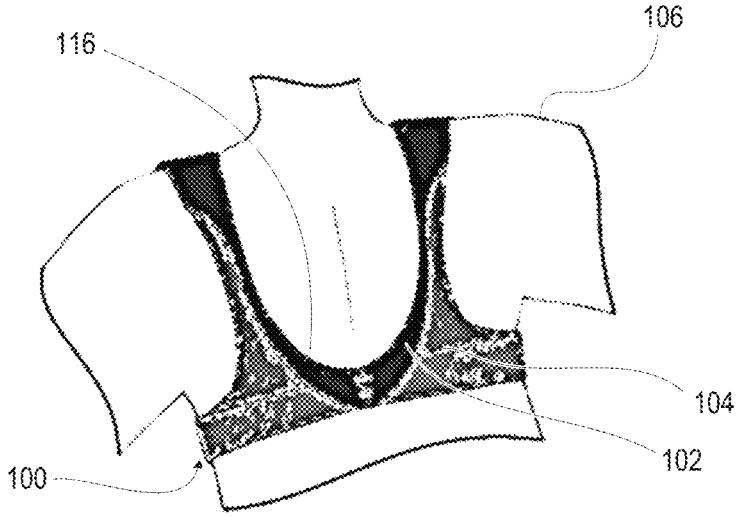
FIG. 2 is a back view of the example bra of FIG. 1 having support and comfort portions in a V-shaped back and worn on the female upper torso, according to one or more embodiments.

Embodiments incorporating teachings of the present disclosure are shown and described with respect to the figures presented herein, in which:

FIG. 1 is a front view of an example bra 100 having support and comfort portions 102, 104 and worn on a female upper torso 106. Support portion 102 is formed of a supportive material that surrounds outer and under surfaces of each breast and extends vertically as left and right straps 108, 110 that flare into wide, thicker straps 112, 114 for comfort and for preventing chafing. FIG. 2 is a back view of the example bra 100 having support and comfort portions 102, 104 in a V-shaped back 116 and worn on the female upper torso. The V-shaped back 116 allows for tighter and better support than straight straps by keeping forces toward the center of the back for better balance of weight.

Figure 3:
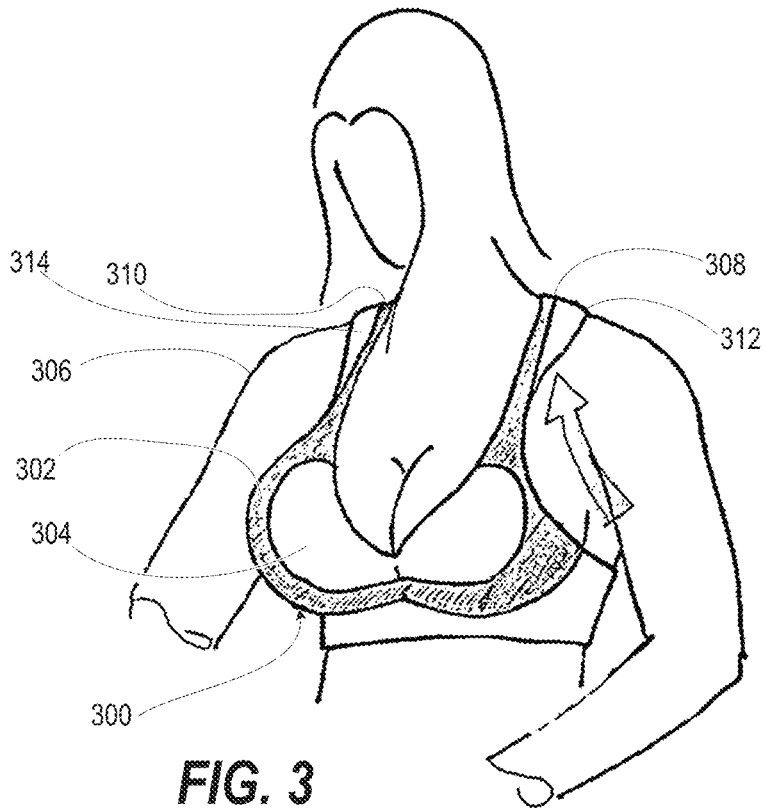
FIG. 3 is a front view of an example bra having support and comfort portions and worn on a female upper torso, according to one or more embodiments.
Figure 4:
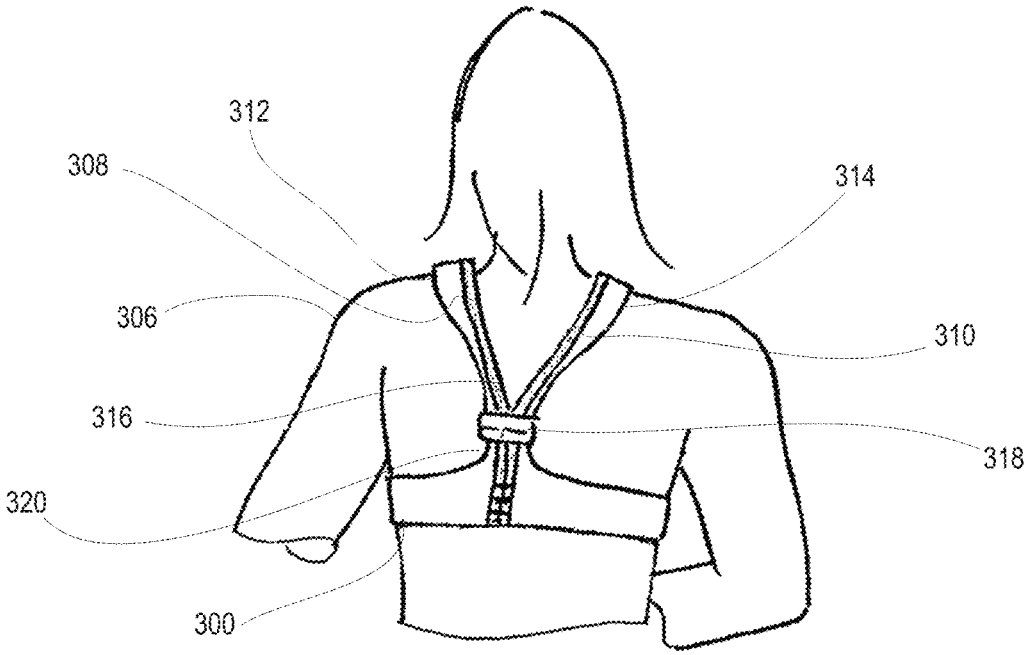
FIG. 4 is a back view of the example bra of FIG. 3 having racerback and worn on the female upper torso, according to one or more embodiments.

FIG. 3 is a front view of an example bra 300 having support and comfort portions 302, 304 and worn on a female upper torso 306. Support portion 302 is formed of a supportive material that surrounds outer and under surfaces of each breast and extends vertically as narrow left and right straps 308, 310. The structural design of the support portion 302 can be embedded within the comfort portion 304 to provide support and lift. The shape of the support portion 302 directs support toward the center of the back to provide better support to the outer sides of each breast. Narrow left and right straps 308, 310 transition from a wider area at the bottom to a conventional width at the top. Comfort portion underlies narrow left and right straps 308, 310 and flares into wide, thicker straps 312, 314 for comfort and for preventing chafing. FIG. 4 is a back view of the example bra 300 having racerback 316 to avoid pressure on the shoulder blades of the female upper torso 306. A back attachment 318 connects narrow left and right straps 308, 310 and within wide, thicker straps 312, 314 at the narrowed portion 320 of the racerback 316.

Figure 5:
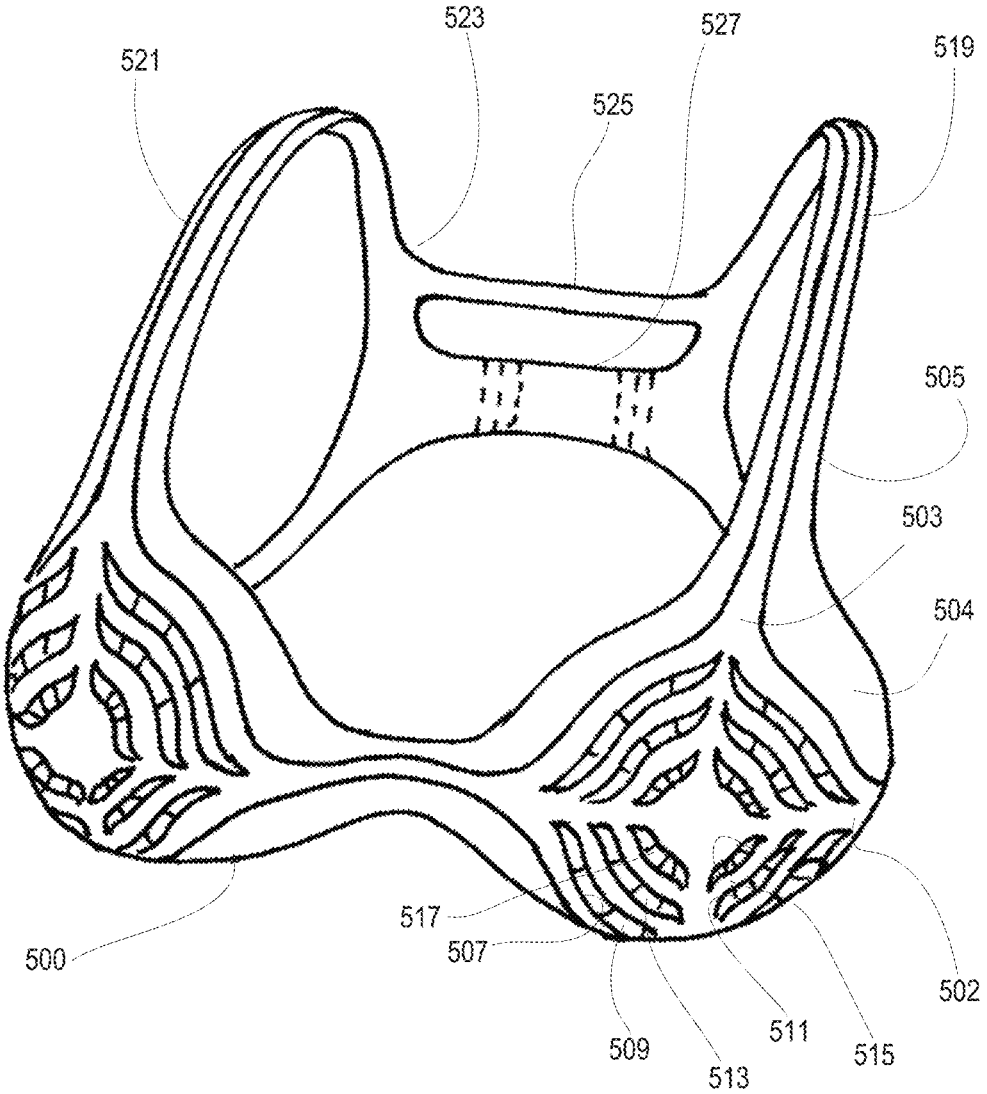
FIG. 5 is a front view of an example bra having spider web shaped support and comfort portions, according to one or more embodiments.

FIG. 5 is a front view of an example bra 500 having spider web patterned support portion 502 and comfort portion 504. The spider web patterned support portion 502 provides a tension grid 503 on a base layer 505. The tension grid 503 includes: (i) an outer ring of apertures 507 on each breast is bridged by a first density material ("A") 509; (ii) an intermediate ring of apertures 511 on each breast within the outer ring of aperture 507 is bridged by a second density material ("B") 513; and (iii) an inner ring of apertures 515 on each breast within the intermediate ring of aperture 511 is bridged by a third density material ("C") 517.

In one or more embodiments, the outer ring of apertures 507 on each breast may comprise 1, 2, 3, 4, or more apertures. In one or more embodiments, the intermediate ring of apertures 511 on each breast may comprise 1, 2, 3, 4, or more apertures. In one or more embodiments, the inner ring of apertures 515 on each breast may comprise 1, 2, 3, 4, or more apertures. In one or more embodiments, the density or "stretch strength" depends on how many rings of apertures, the number of apertures and the size of the particular apertures. Densities A-C can be selected for different types of fit. Left and right straps 519, 521 attach to a closed back 523 with an upper horizontal band 525 and a lower horizontal band 527 formed of an expandable material for tension. The closed back 523 facilitates slipping on the bra 500.

Figure 6:
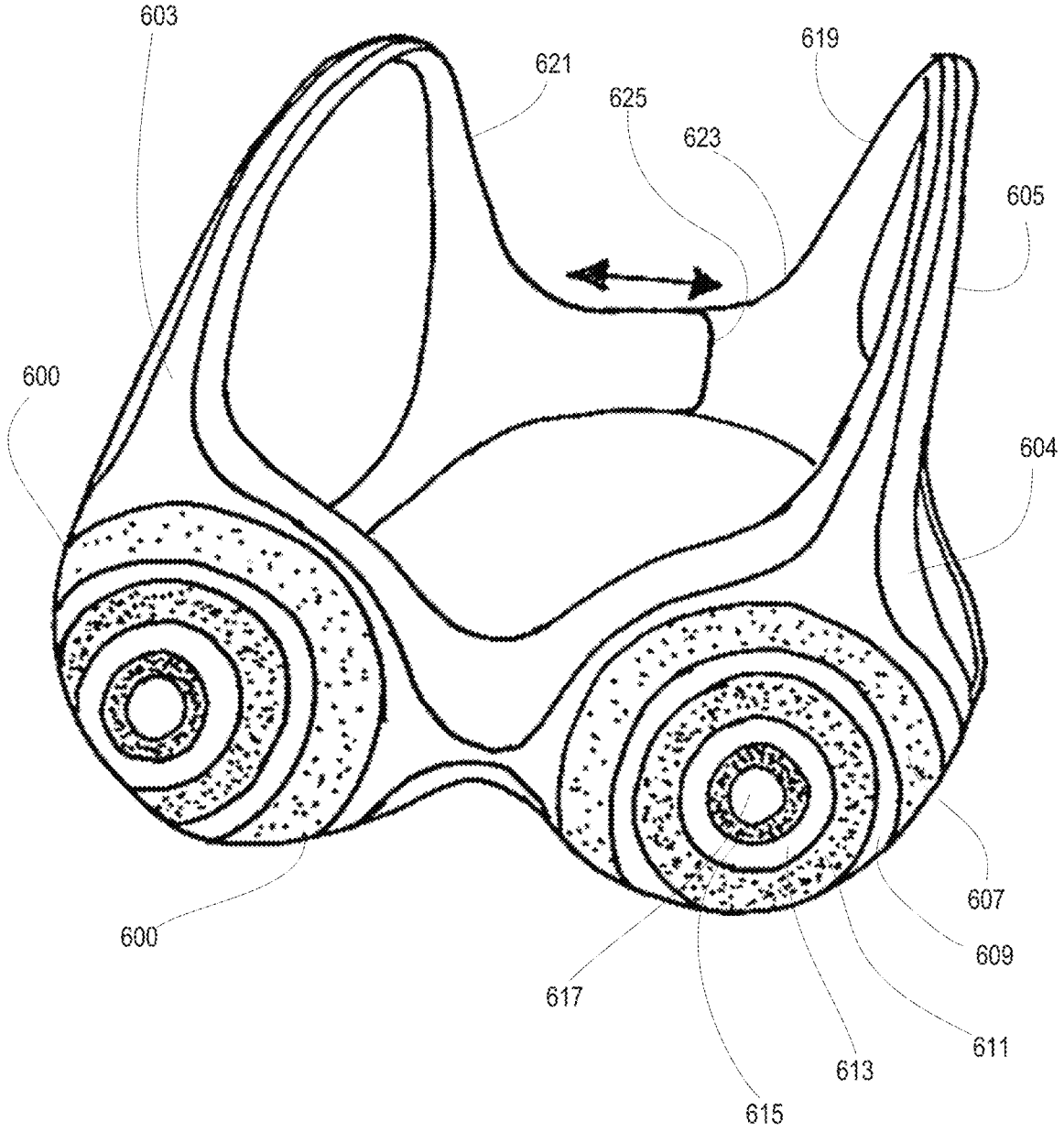
FIG. 6 is a front view of an example bra having bullseye shaped support and comfort portions, according to one or more embodiments.

FIG. 6 is a front view of an example bra 600 having bullseye patterned support portion 602 and comfort portion 604. The bullseye patterned support portion 602 provides a tension strap 603 on a base layer 605. The bulls eye patterned support portion 602 includes: (i) an outer ring of 607 on each breast formed of a first density material ("A") around a support ring 609; (ii) an intermediate ring 611 on each breast of a second density material ("B") inside of the support ring 609 and surrounding support ring 613; and (ii) an inner ring 615 on each breast within the support ring 613 of a third density material ("C") around a center support disk 617. Concentric rings 607, 611, 615 allows for better fit and tension/pressure when supporting the breast. Densities A-C can be selected for different types of fit. The density of the pattern changes as the pattern expands. Left and right straps 619, 621 attach to a closed back 623 with an expandable back grip 625 for tension.

Figure 7:
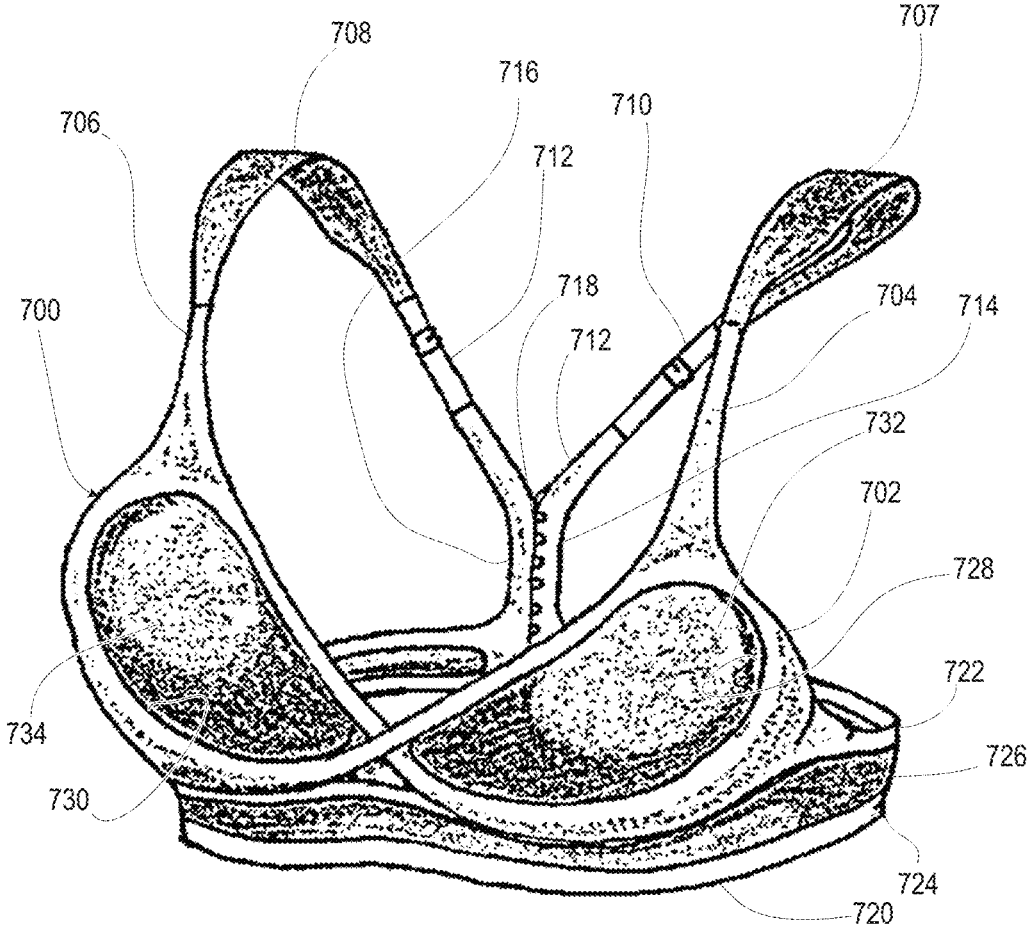
FIG. 7 is a front view of an example bra having X-design support and comfort portions with adjustable length straps, according to one or more embodiments.

FIG. 7 is a front view of an example bra 700 having an X-design structure portion 702 that encircles each breast and crossing support extend to left and right shoulder straps 704, 706 with wider top sections 707, 708. Each shoulder straps 704, 706 in back has a buckle adjustment section 710, 712 in a V-shaped portion 712. Below each adjustment buckle section 710, 712 are parallel vertical attachment sections 714, 716 that include respective vertical rows of hooks and eye closures 718. Leaving a selected number of hooks and eye closures 718 unattached is one way of adjusting the fit of the bra 600. The parallel vertical attachment sections 714, 716 attach to respective ends of a bra band 720 that extends below the X-design structure portion 702 and sized to encompass a woman's torso. The bra band 720 includes an upper and a lower structural band 722, 724 separated by a comfort and aesthetic band 726 such as an aesthetic lace material. Respective apertures 728, 730 in the X-design structure portion 702 over each breast can also be covered by comfort aesthetic panels 732, 734 such as aesthetic lace material.

Figure 8:
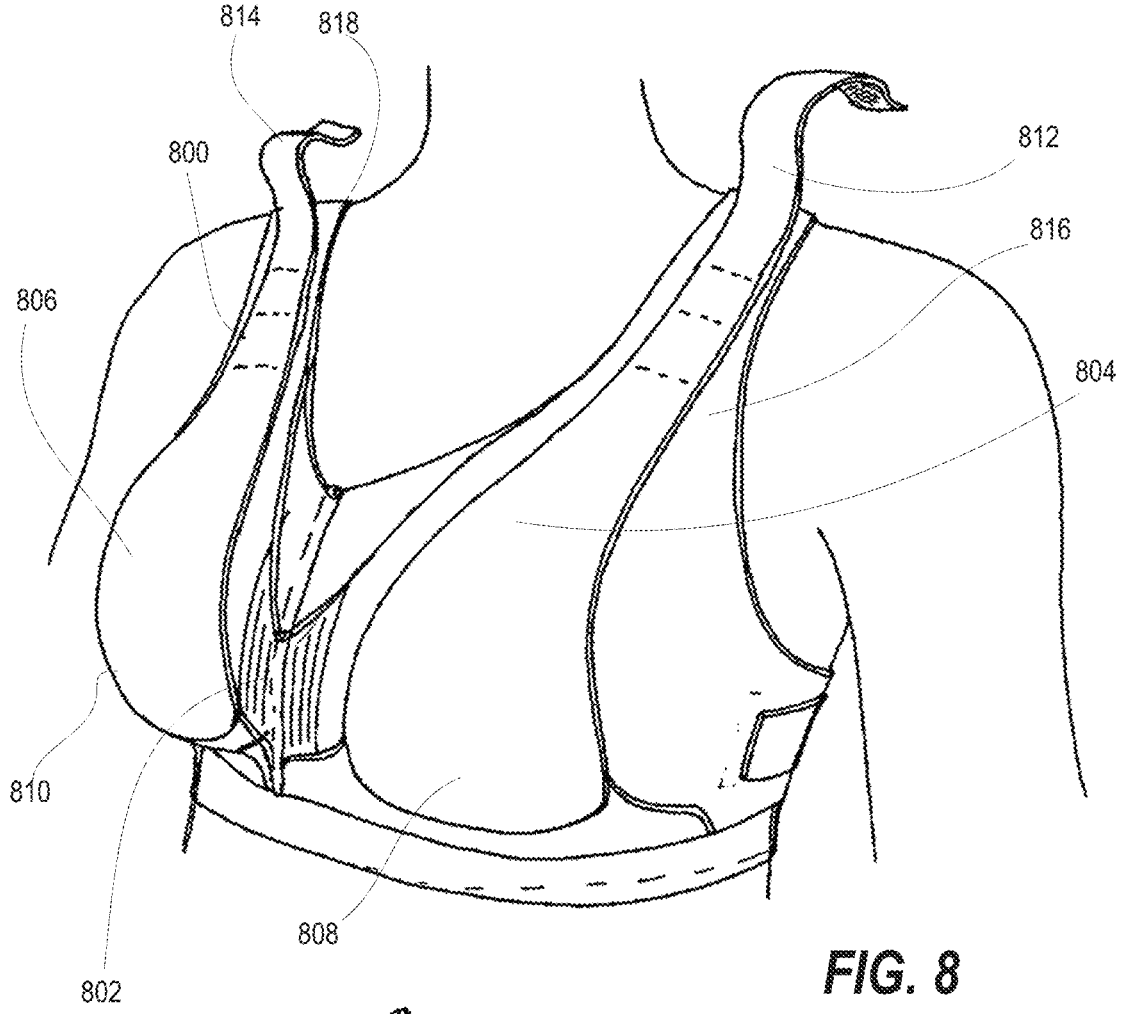
FIG. 8 is a front view of an example bra having front attachment and support straps and worn on a female upper torso, according to one or more embodiments.
Figure 9:
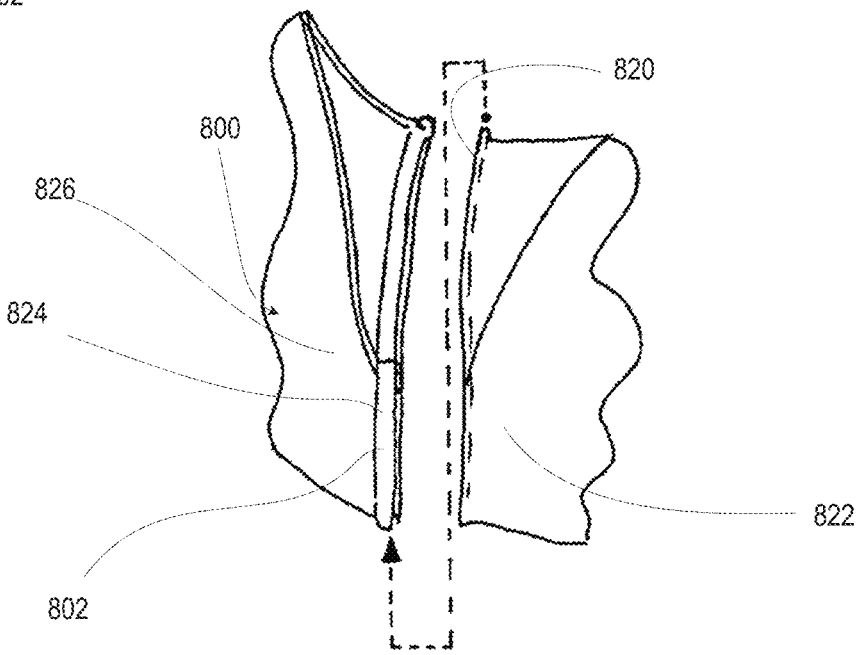
FIG. 9 is a detail front view of the front attachment of the example bra of FIG. 8, according to one or more embodiments.

FIG. 8 is a front view of an example bra 800 having front attachment mechanism 802 and left and support straps 804, 806. Each support strap has a lower cup 808, 810 that covers a respective breast and extend upward as an outer support strap 812, 814 that is adjustably engaged to an underlying base strap 816, 818, respectively. FIG. 9 depicts the attachment mechanism as a vertical rod member 820 attached along a right vertical edge of a left chest base portion 822 of the bra 800. The vertical rod member 820 is received from the bottom of a slotted channel 824 attached along a right chest base portion 826 of the bra 800.

Figure 10:
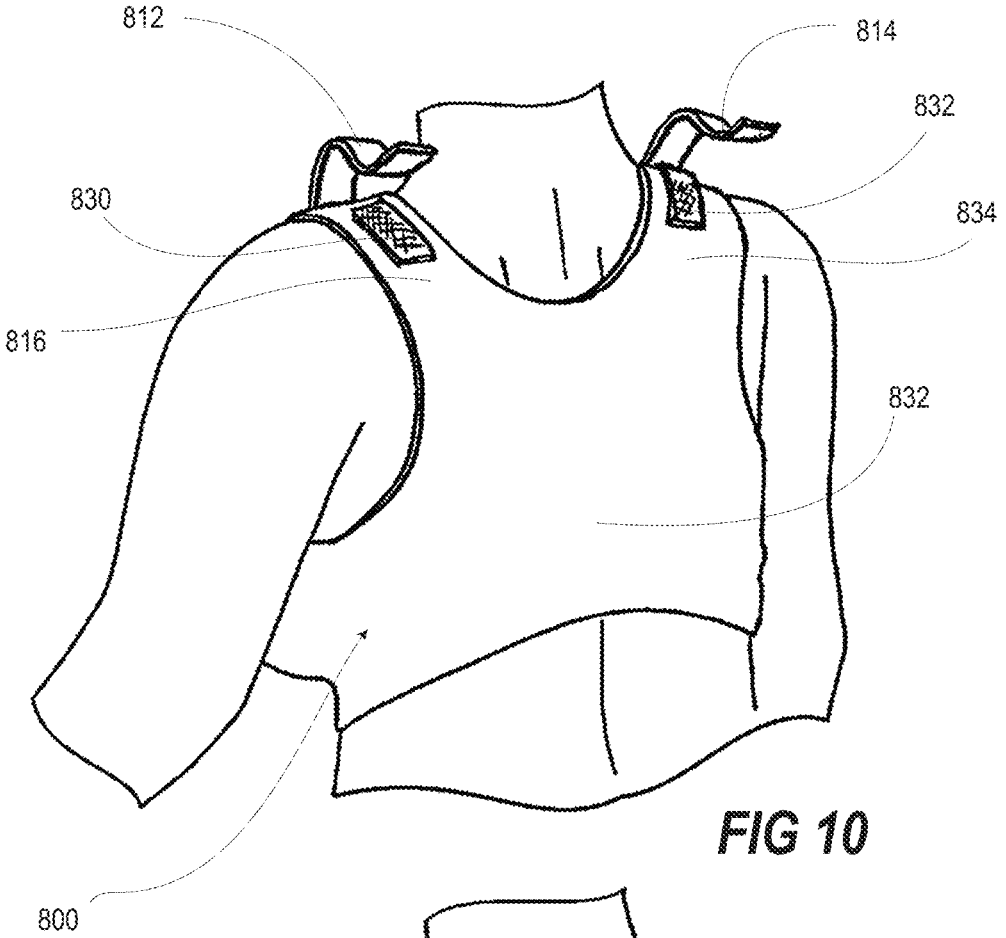
FIG. 10 is a back view of one version of the example bra of FIG. 8 having Velcro strap attachments and worn on the female upper torso, according to one or more embodiments.
Figure 11:
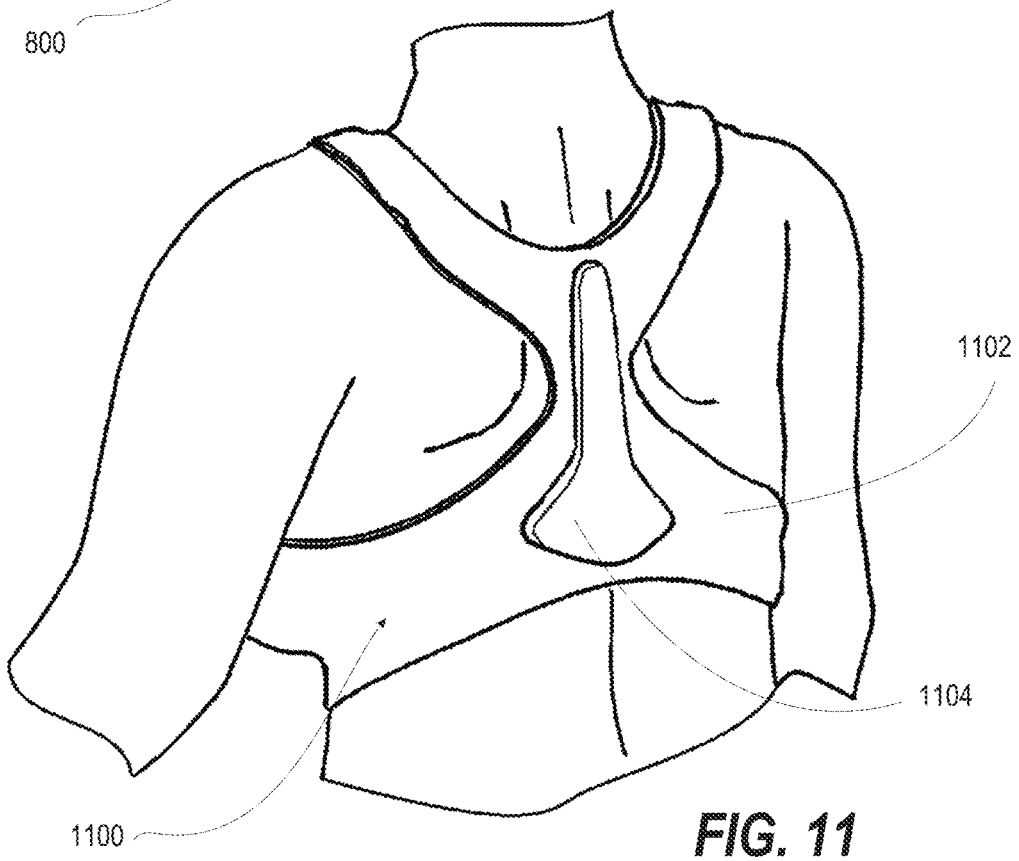
FIG. 11 is a back view of an example bra having a vertical back splint support and worn on the female upper torso, according to one or more embodiments.
Figure 12:
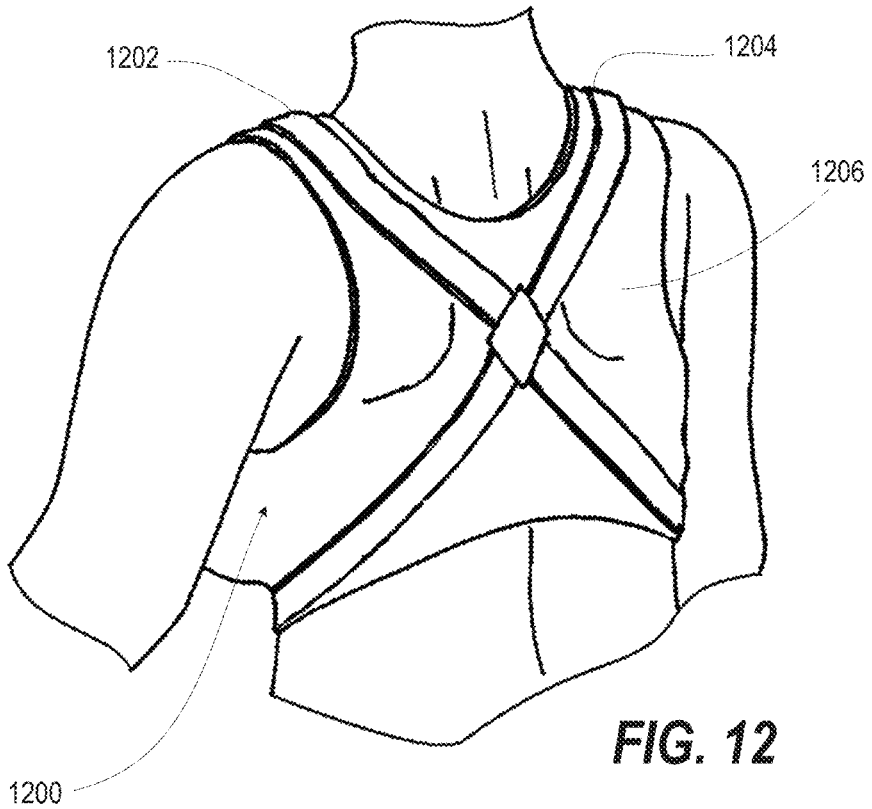
FIG. 12 is a back view of an example bra having crossed support straps and worn on the female upper torso, according to one or more embodiments.
Figure 13:
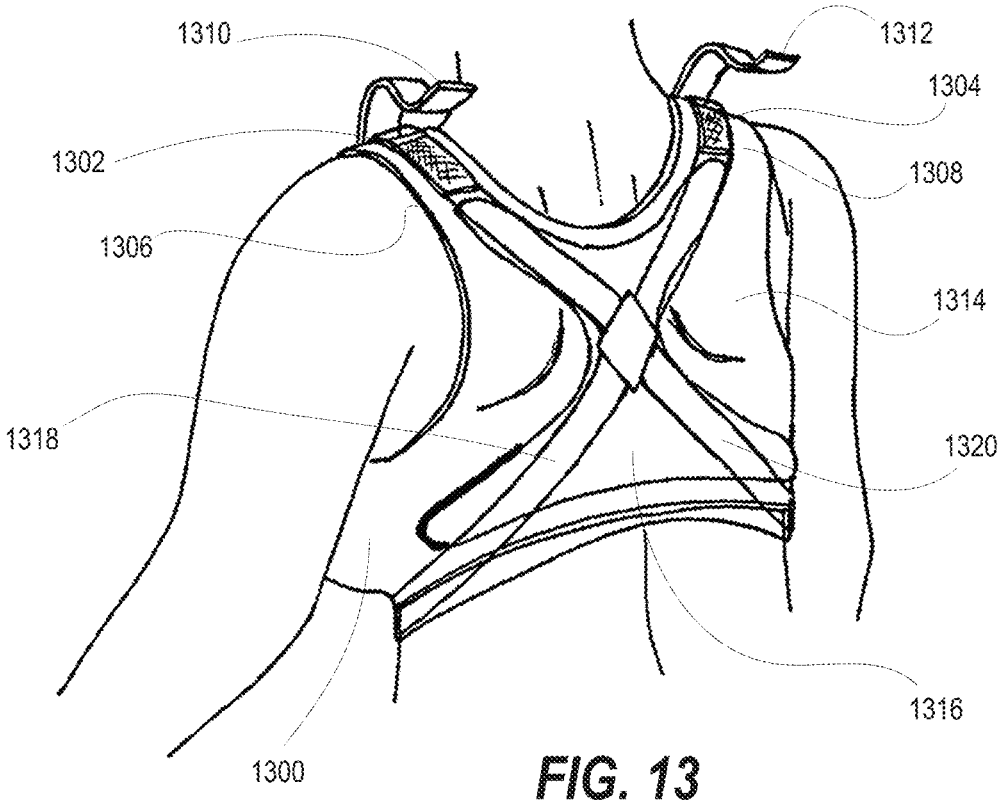
FIG. 13 is a back view of another version of the example bra of FIG. 8 having Velcro strap attachments, back splint support, crossed support straps, and worn on the female upper torso, according to one or more embodiments.

FIG. 10 is a back view of one version of the example bra 800 having Velcro strap attachments 830, 832 on each underlying base strap 816, 818 to engage to respective outer support strap 812, 814. The bra 800 includes a full back panel 834. FIG. 11 is a back view of an example bra 1100 having an X-shaped fabric back panel 1102 stiffen by a vertical back splint support 1104 positioned along the spine of a wearer. FIG. 12 is a back view of an example bra 1200 having X-shaped crossed outer support straps 1202, 1204 attached over an X-shaped fabric back panel 1206 for additional structural support. FIG. 13 is a back view of an example bra 1300 having Velcro strap attachments 1302, 1304 on each underlying base strap 1306, 1308 to engage to respective outer support strap 1310, 1312. The bra 1300 includes a full back panel 1314 stiffen by an inverted T-shaped back splint support 1316 and an X-shaped crossed outer support straps 1318, 1320.

Figure 14:
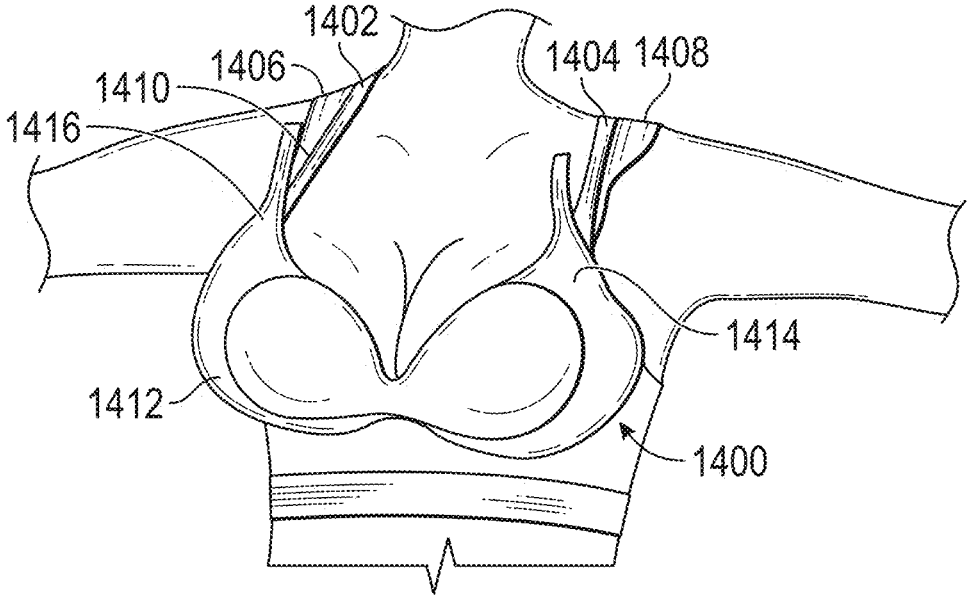
FIG. 14 is a front view of an example bra having support and comfort portions with dual layer, hook adjustable front straps and worn on a female upper torso, according to one or more embodiments.
Figure 15:
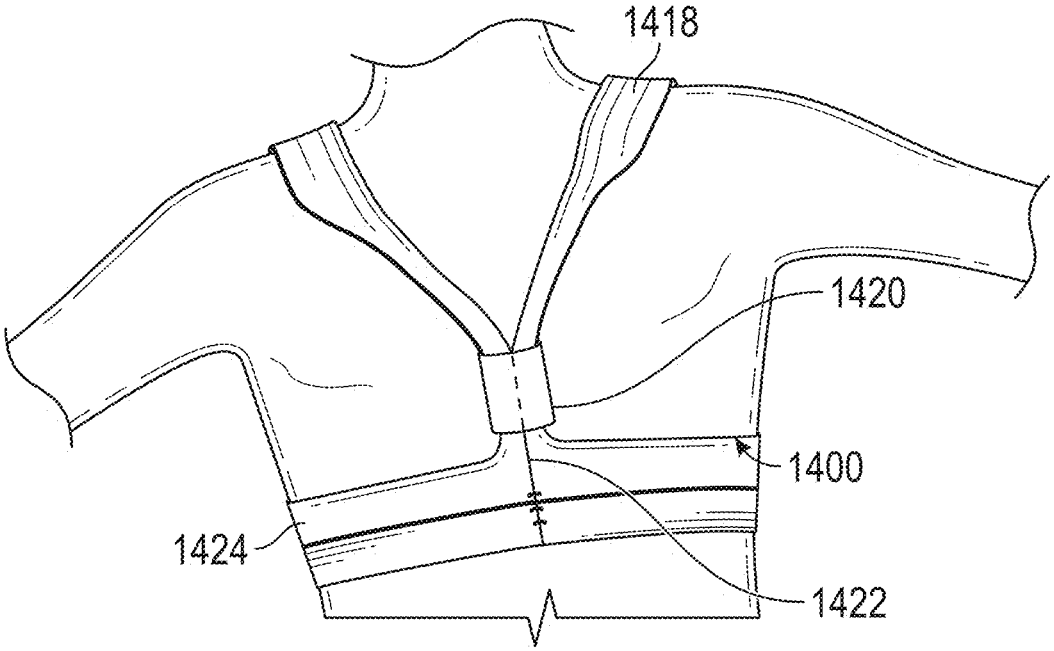
FIG. 15 is a back view of the example bra of FIG. 14 having racerback and worn on the female upper torso, according to one or more embodiments.
Figure 16:
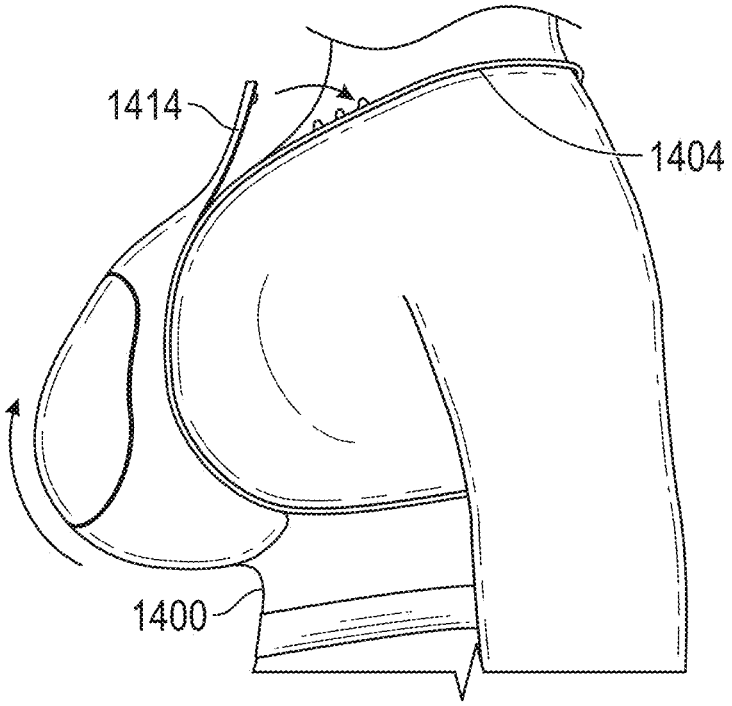
FIG. 16 is a side view of an example bra having support and comfort portions with dual layer, hook adjustable front straps and worn on a female upper torso, according to one or more embodiments.
Figure 17:
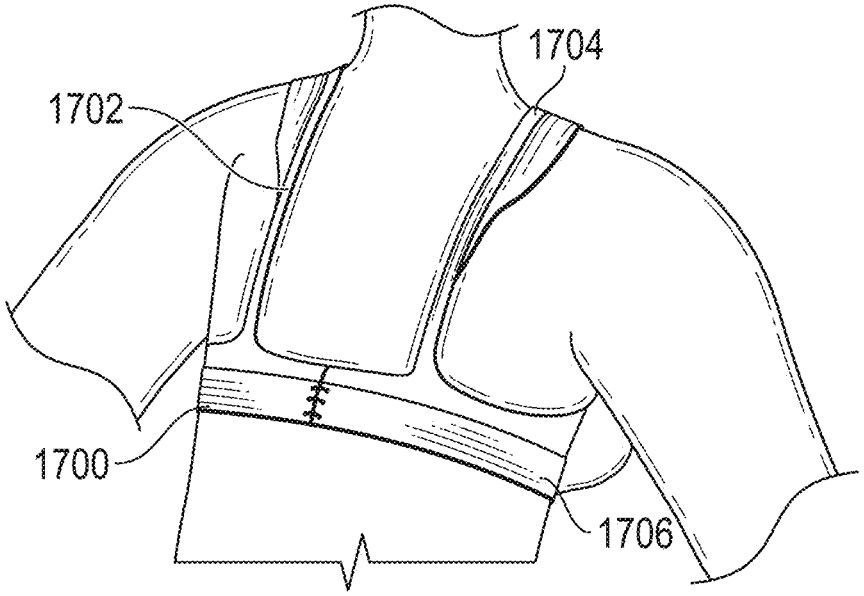
FIG. 17 is a back view of the example bra of FIG. 16 having parallel back straps and worn on the female upper torso, according to one or more embodiments.

FIG. 14 is a front view of an example bra 1400 having an underlying support harness 1402 with left and right narrow straps 1404, 1406 supported across the top of the shoulders by wide base layers 1408, 1410. support portion and comfort portions with dual layer, hook adjustable front straps and worn on a female upper torso. An outer structure support 1412 encompasses lower and outer surfaces of the breasts and has upward extending and tapering left and right adjustment straps 1414, 1416. FIG. 15 is a back view of the example bra 1400 having a racerback razor back 1418 held by sleeve 1420. A hook and eye attachment mechanism 1422 is formed vertically through sleeve 1420 and ends of a bra band 1424. FIG. 16 is a side view of the example bra 1400 depicting adjustment of the left adjustment strap 1414 onto the left narrow strap 1404. FIG. 17 is a version of an example bra 1700 with parallel left and right straps 1702, 1704 that attach to a bra band 1706 in back.

Figure 18:
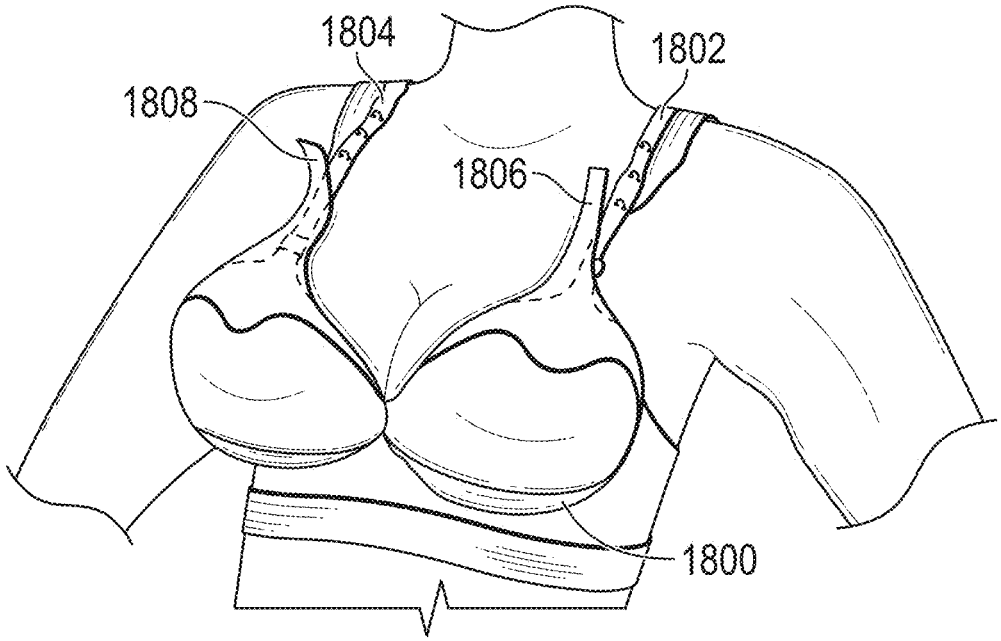
FIG. 18 is a front view of an example bra having buckle adjusted under strap and hook adjustable outer strap and worn on a female upper torso, according to one or more embodiments.
Figure 19:
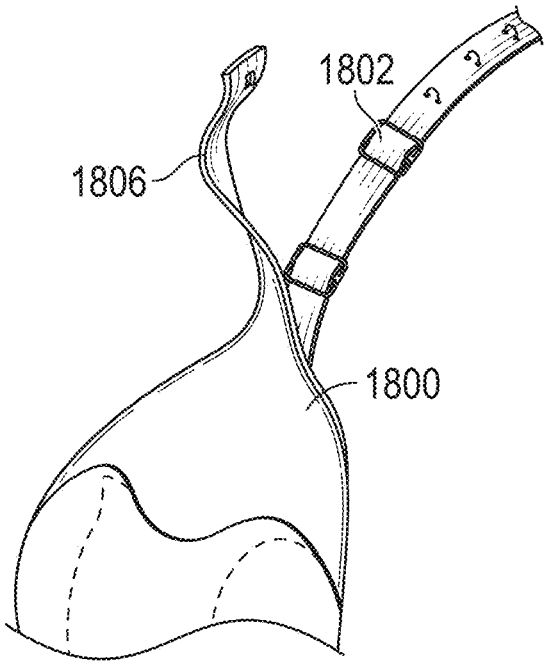
FIG. 19 is a front isometric detail view of the example bra of FIG. 18 of the under and over straps, according to one or more embodiments.
Figure 20:
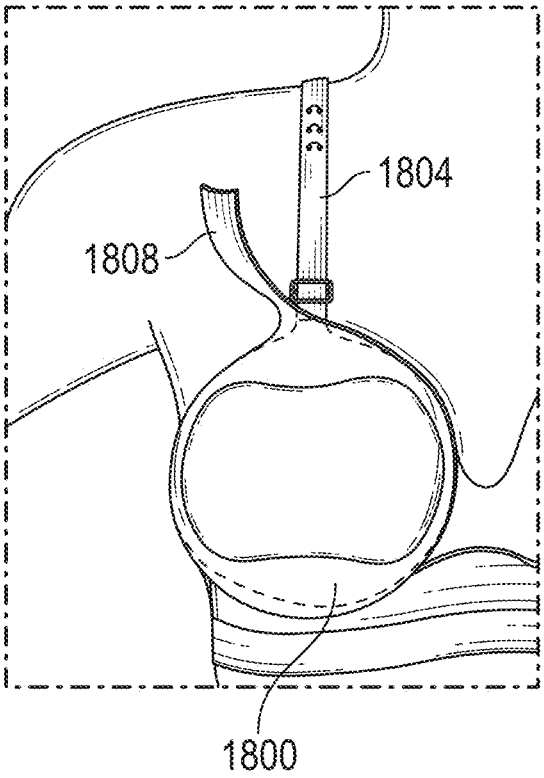
FIG. 20 is a front right view of the example bra of FIG. 18 of the under and over straps, according to one or more embodiments.

FIG. 18 is a front view of an example bra 1800 having left and right buckle adjusted under straps 1802, 1804 and left and right hook adjustable outer straps 1806, 1808 for additional adjustment. For example, left and right buckle adjusted under straps 1802, 1804 may provide a desired sizing of vertical positioning. left and right hook adjustable outer straps 1806, 1808 assert additional adjustment with also center force on the breasts. FIG. 19 is a front isometric detail view of the left buckle adjusted under strap 1802 and left hook adjustable outer strap 1806 of the example bra 1800. FIG. 20 is a front right view of the right buckle adjusted under strap 1802 and right hook adjustable outer strap 1806 of the example bra 1800.

Figure 21:
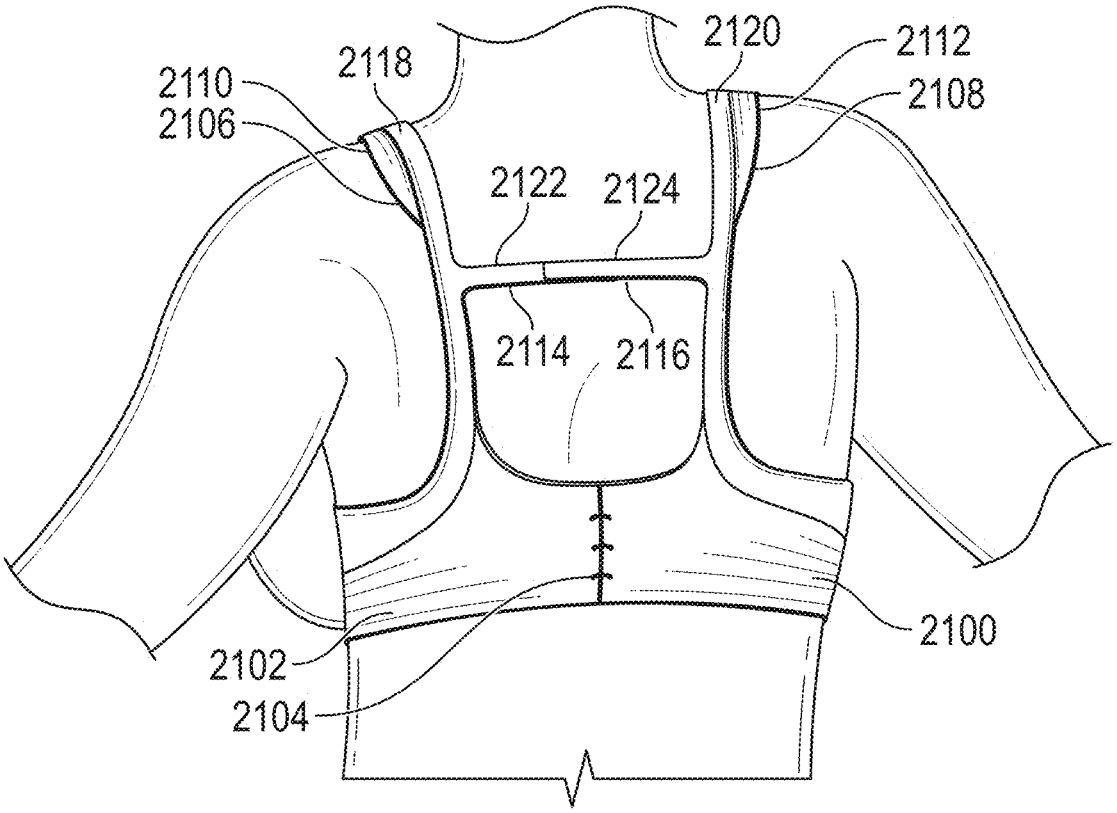
FIG. 21 is a back view of an example bra having under and over straps with a lateral hooked adjustment of the over strap according to one or more embodiments.
Figure 22:
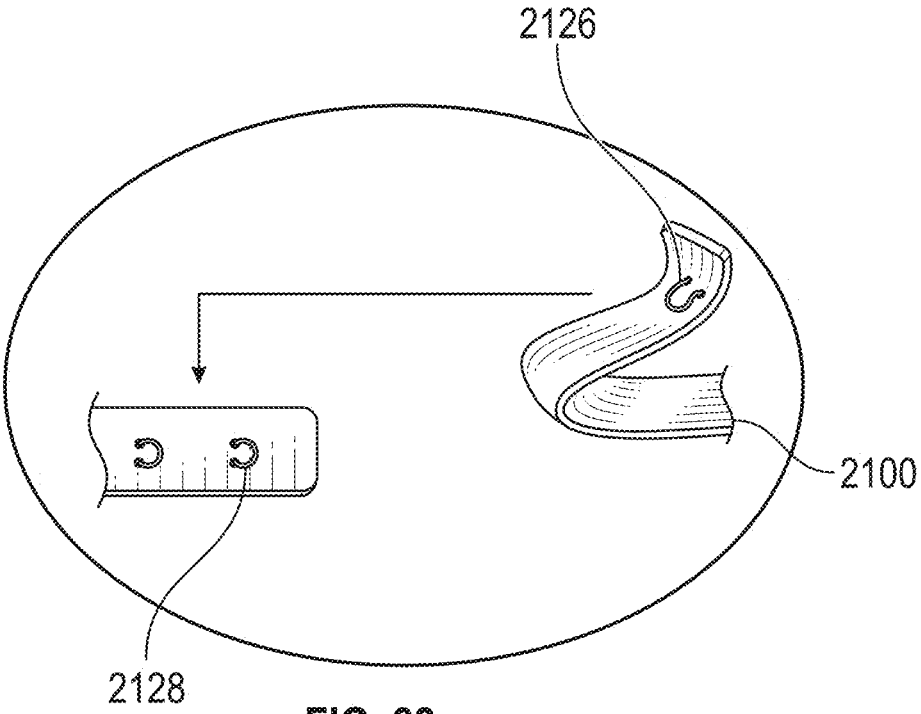
FIG. 22 is a detail view of the lateral hooked adjustment of the example bra of FIG. 21, according to one or more embodiments.

FIG. 21 is a back view of an example bra 2100 having a bra band 2102 with hook and eye closure attachments 2104. Left and right straps 2106, 2108 are vertical and parallel attached to the bra band 2102 on each lateral side of the hook and eye closure attachments 2104. Each left and right straps 2106, 2108 includes a wider base strap 2110, 2112 respectively that have horizontal bands 2114, 2116. Left and right straps 2106, 2108 also include an overlaying structural band 2118, 2120 that have horizontal bands 2122, 2124. FIG. 22 is a detail view of a lateral hooked adjustment of the example bra 2100 provided by hook 2126 and eye closures 2128 respectively on the horizontal bands 2122, 2124 of the overlaying structural band 2118, 2120 to adjustably maintain positioning of the left and right straps 2106, 2108 on the shoulders.

Figure 23:
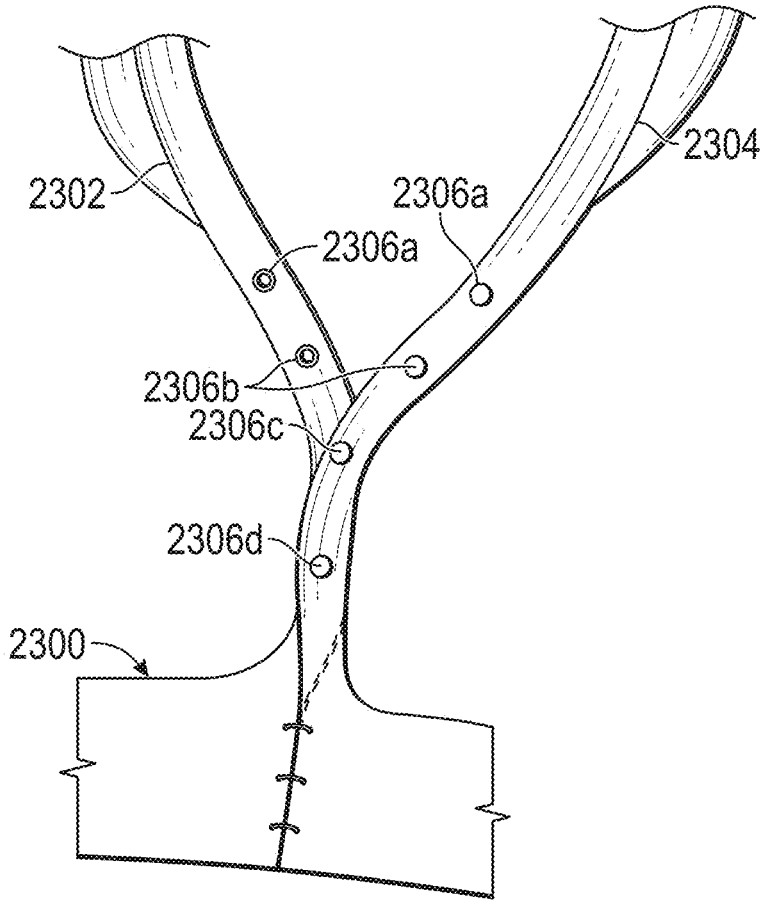
FIG. 23 is a back view of an example bra having racerback straps with a color coded vertical adjustment feature, according to one or more embodiments.

FIG. 23 is a back view of an example bra 2300 having left and right racerback straps 2302, 2304 whose top ends can be brought into tighter alignment by snapping upper snap closure pairs 2306*a*-2306*d*. Since making such adjustments can be accomplished easier by another person, each snap closure pair 2306*a*-2306*d* is uniquely colored coded to facilitate the wearer communicating which snap closure pairs 2306*a*-2306*d* should be snapped for a desired fit.

Figure 24:
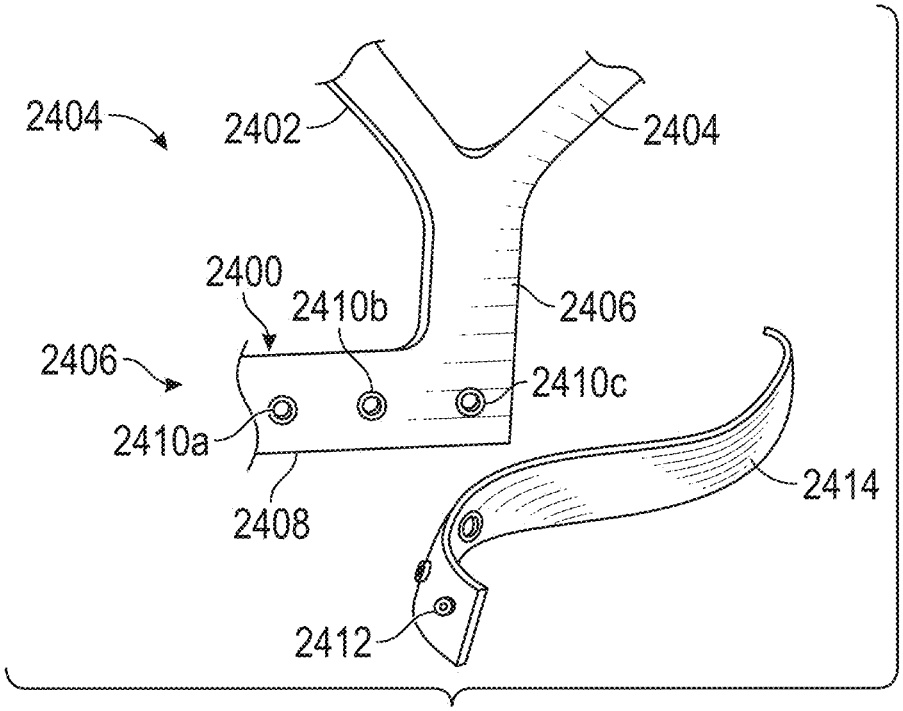
FIG. 24 is a detail view of an example bra having a color coded horizontal adjustment feature, according to one or more embodiments.

FIG. 24 is a back view of an example bra 2400 having racerback straps 2402, 2404 that come together in a vertical attachment 2406 to one side of a bra band 2408. A horizontal series of inner snap components 2410*a*-2410*c* are color coded to receive an outer snap component 2412 on a horizontal strap 2414.

Figure 25:
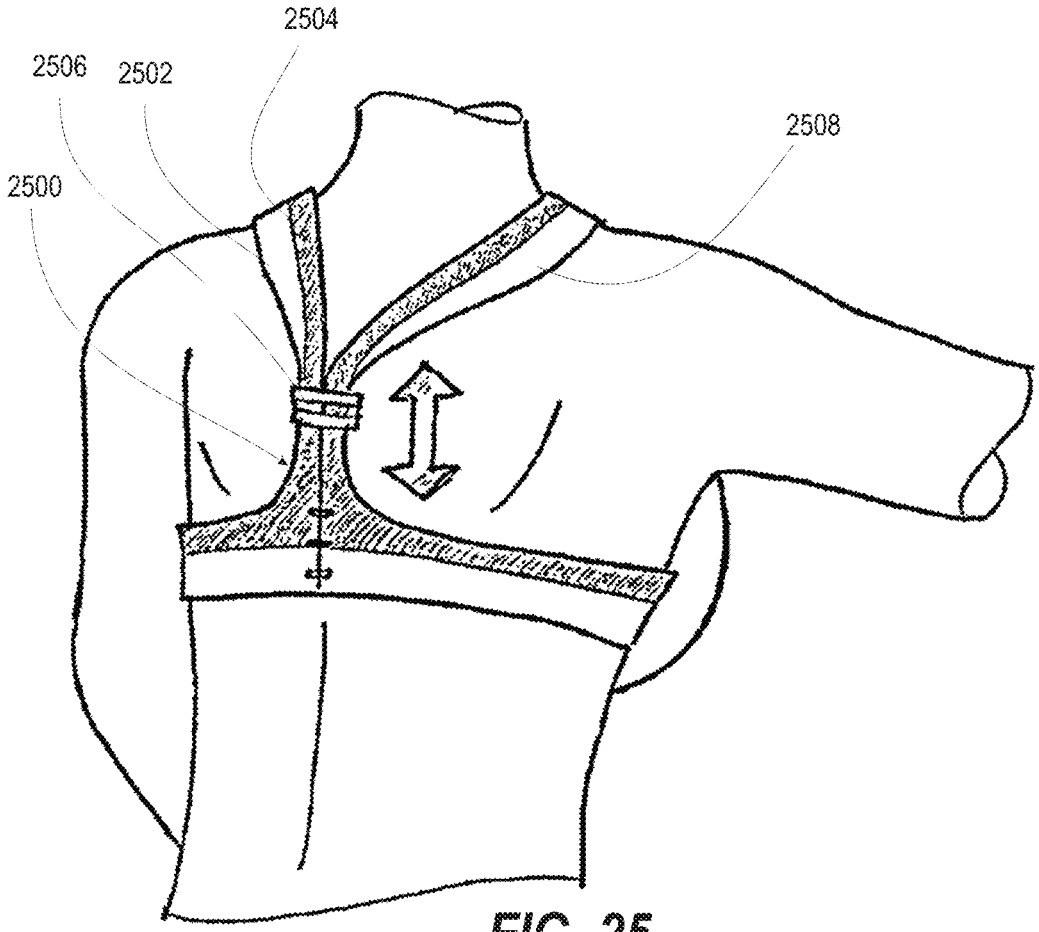
FIG. 25 is a back view of an example bra having racerback straps with a vertical slide adjustment feature, according to one or more embodiments.
Figure 26:
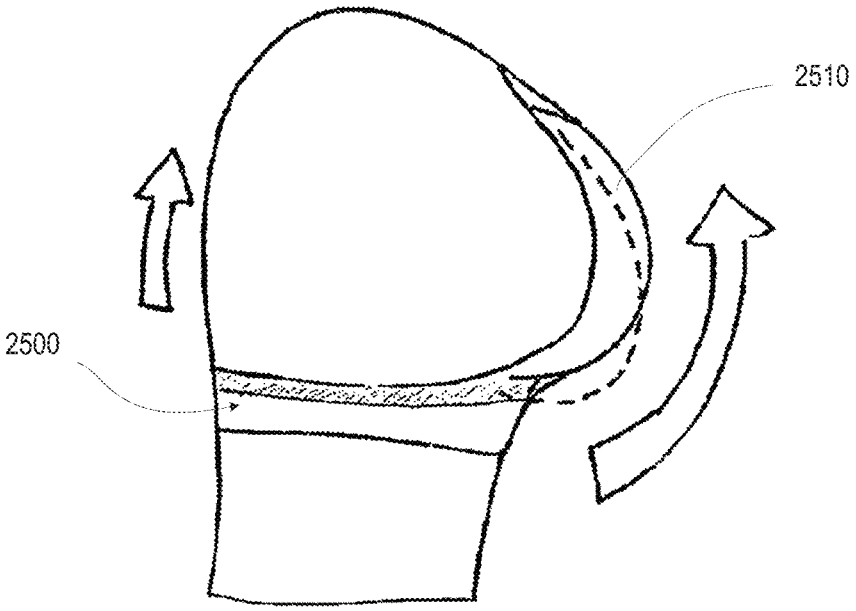
FIG. 26 is a side view of the example bra of FIG. 25, according to one or more embodiments.

FIG. 25 is a back isometric view of an example bra 2500 having a racerback 2502 of left and right straps 2504, 2506 that can be adjustably brought together and apart by a vertically adjustable clip 2508. FIG. 26 is a side view of the example bra 2500 that vertically adjusts a front portion 2510 based on the position of the adjustable clip 2508 (FIG. 25).

Figure 27:
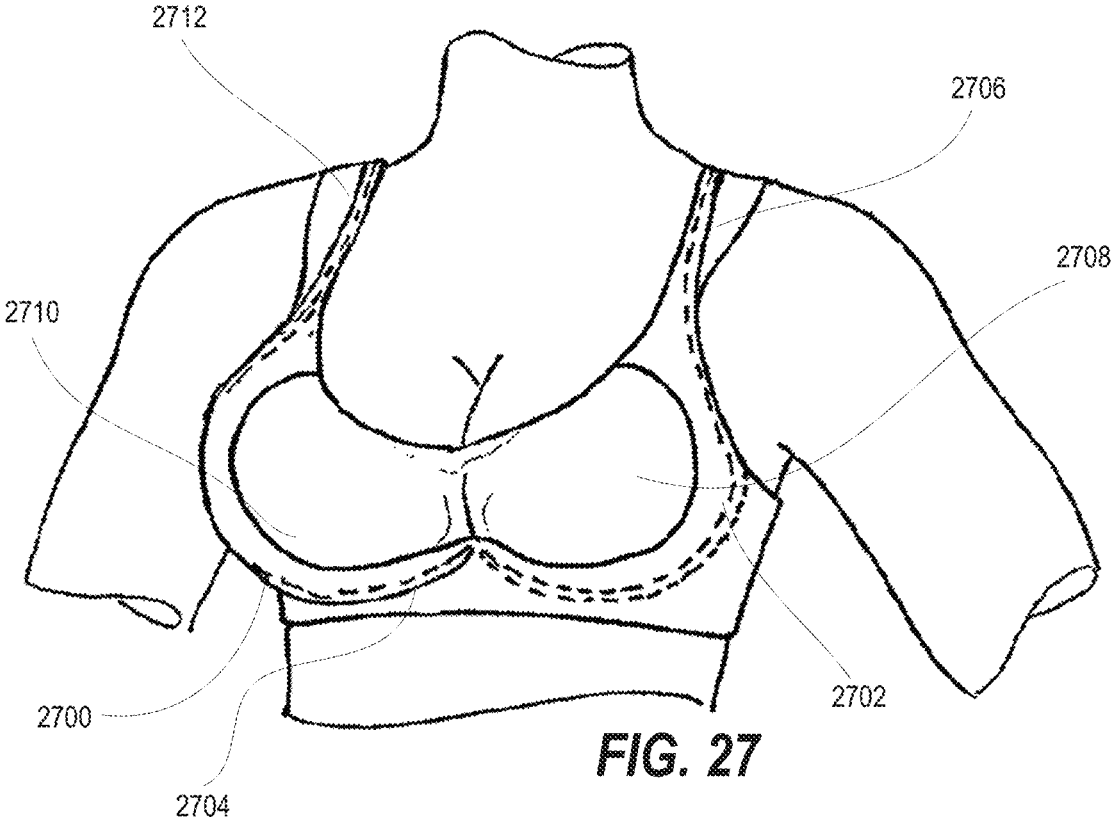
FIG. 27 is a front view of an example bra having a vertically adjustable underwire feature, according to one or more embodiments.
Figure 28:
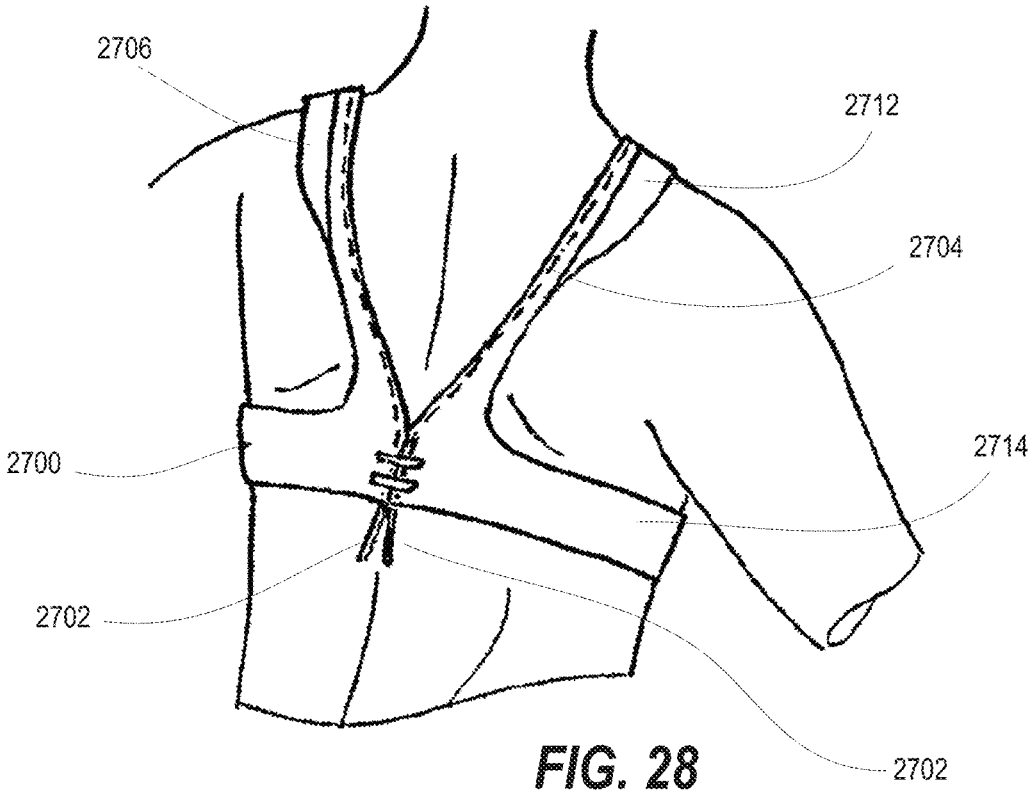
FIG. 28 is a back view of the example bra of FIG. 27, according to one or more embodiments.

FIG. 27 is a front view of an example bra 2700 having a vertically adjustable underwire 2702 that is guided by through a looped channel 2704 that passes through a left strap 2706, under both left and right breast cups 2708, 2710, and back up a right strap 2712. FIG. 28 is a back view of the example bra 2700. Ends of the adjustable underwire 2702 exit below a bra band 2714 for adjustment to change tension and vertical support to left and right breast cups 2708, 2710 (FIG. 27). In one or more embodiments, the wire 2702 is attached to the bra 2700 between left and right breast cups 2708, 2710 (FIG. 27). Adjustment can be specific to one breast cup 2708, 2710 (FIG. 27).

Figure 29:
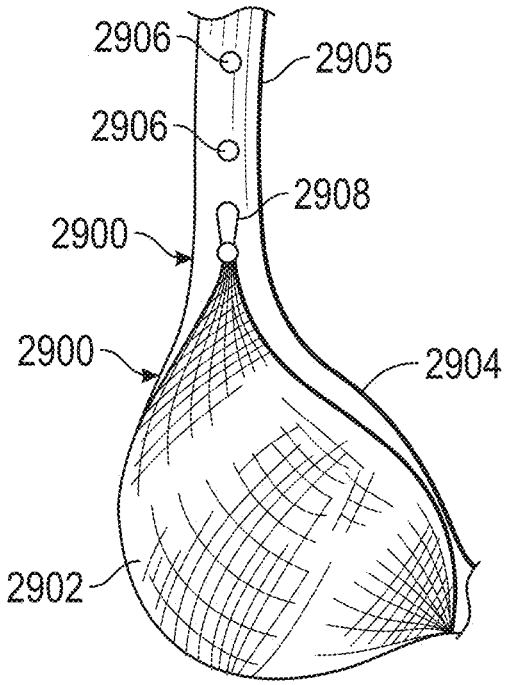
FIG. 29 is a right front view of an example bra having a vertically adjustable outer compressive mesh cup, according to one or more embodiments.
Figure 30:
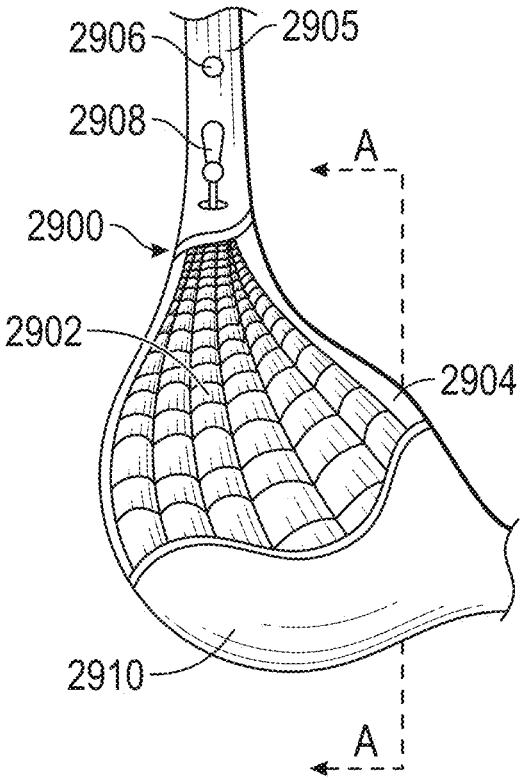
FIG. 30 is a right front view of the example bra of FIG. 29 with a partially cutaway outer layer, according to one or more embodiments.
Figure 31:
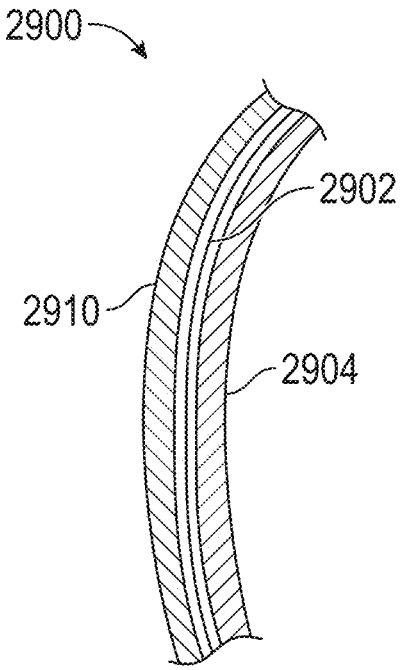
FIG. 31 is a cross sectional view of the example bra of FIG. 30 along lines A-A, according to one or more embodiments.

FIG. 29 is a right front view of an example bra 2900 having a vertically adjustable outer compressive web mesh cup 2902 that is shaped to encompass at least a lower portion of an inner layer 2904 of the bra 2900. A shoulder strap 2905 includes one or more locking tabs 2906 that can engage to a top tab 2908 of the mesh cup 2902. Vertically attaching the top tab 2908 at a higher locking tab 2906 increases the vertical lift on the inner layer 2904. FIG. 30 is a right front view of the example bra 2900 with a partially cutaway outer layer 2910. FIG. 31 is a cross sectional view of the example bra 2900 depicting the web mesh cup 2902 sandwiched between the inner and outer layers 2904, 2910.

Figure 32:
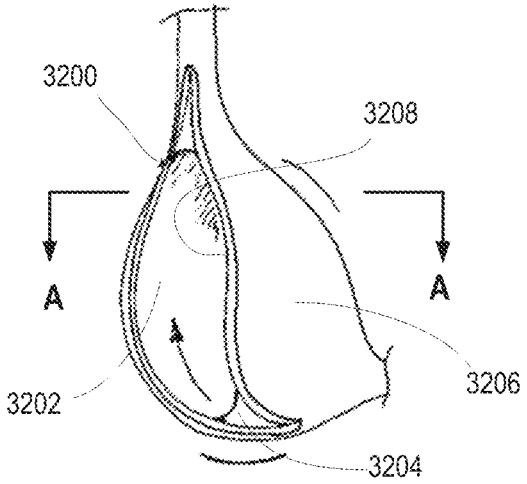
FIG. 32 is a right front view of an example bra having a zip adjusted lift compression plate in an unzipped state, according to one or more embodiments.
Figure 33:
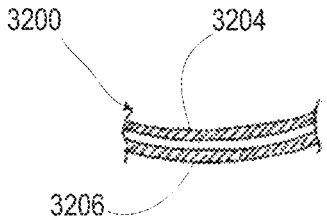
FIG. 33 is a cross sectional view of the example bra of FIG. 32 along lines B-B, according to one or more embodiments.
Figure 34:
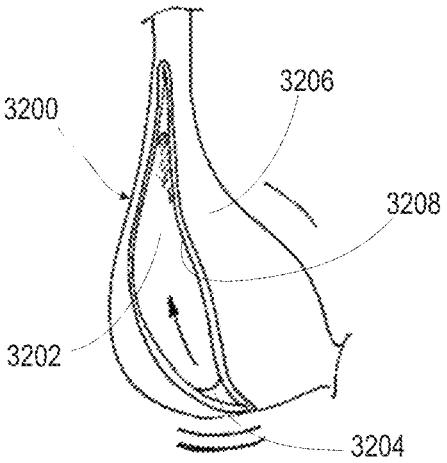
FIG. 34 is a right front view of the example bra of FIG. 32 having the zip adjusted lift compression plate in partially zipped state, according to one or more embodiments.
Figure 35:
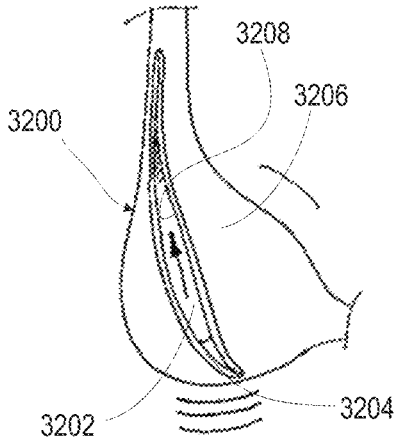
FIG. 35 is a right front view of the example bra of FIG. 32 having the zip adjusted lift compression plate in a fully zipped state, according to one or more embodiments.

FIG. 32 is a right front view of an example bra 3200 having a zip adjusted lift compression plate 3202. An inner layer 3204 is cup shaped. The compression plate 3202 is positioned along an outer front side of the inner layer 3204. An outer layer 3206 has a vertical zipped opening 3208 that is in a fully unzipped state. Lateral expansion of the vertical zipped opening 3208 reduces the lifting compression for of the compression plate 3202. FIG. 33 is a cross sectional view of the example bra 3200 along lines B-B showing a gap 3210 between the inner layer 3204 and the zipped outer layer 3206. FIG. 34 is a right front view of the example bra 3200 with the vertical zipped opening 3208 in partially zipped state. Compression plate 3202 is urged inwardly providing lift and inward shaping. FIG. 35 is a right front view of the example bra 3200 with the vertical zipped opening 3208 in a fully zipped state. Compression plate 3202 is urged further inwardly providing additional lift and inward shaping.

In one or more embodiments, an optional front opening hook or clasp may be provided between and connected to the two cups in addition to the under bust band for cleavage adjustment if worn under a more revealing garment.

In one or more embodiments, the bra can be made of any suitable material that is flexible and supportive. The cups are normally composed of conventional fabric used for bra manufacturing, such as cloth, lace, silk, net, transparent material or other desired materials, and maybe padded, and more preferably, substantially padded. In one or more embodiments, the cups are formed of a single piece of material but may be fabricated from numerous pieces and layers. They may be ornamental or decorated. In one or more embodiments, the cups maintain their contour or form by any convenient means, preferably by means of a reinforcing underwire. In one or more embodiments, the underwire may be plastic or metal or any other suitable material.

In one or more embodiments, the straps are made of either stretchable elastic, conventional non-transparent fabric material with a non-slip backing, or made of a transparent or substantially transparent elastomeric polyurethane material, of which a wide variety are available in the marketplace such as the trademark Lycra. In one or more embodiments, the plastic materials may themselves be stretchable and light tinting may also be appropriate. The same applies to the material of the cups when they are also composed of transparent material. In one or more embodiments, the straps include detachable securing means, which may be any means that can be easily attached or detached, such as clasps, hooks, eyes, buttons, loops, openings snaps, rings and other fasteners are used to allow either the shoulder straps to be fastened to the cups and the sides, if used, or one of the straps be fastened to each cup for a halter-neck design if desired. In one or more embodiments, the straps also include length adjusting means, which may be any means that allows for the adjustment of the length of the straps, such as a sliding or adjustable ring or bracket.

In one or more embodiments, the bra band comprises a front under bust band attached to and underlying the bra cups and bottoms of the two side portions and back band straps extending beyond the side portions to the back of the wearer and adapted to be wrapped about the waist of the user in opposite directions, terminating at the front of the user, where they are secured together in any convenient manner by a securing means, such as by clasps, hooks, eyes, buttons, loops, openings snaps, rings and other fasteners. In one or more embodiments, the back bands are provided with length adjustment means, which may be any means that allows for the adjustment of the length of the straps, such as a sliding or adjustable ring or bracket. In one or more embodiments, the bra band including the font under bust band, side portions and back band straps can be made of any suitable material that is flexible and supportive such as conventional bra manufacturing fabrics including lace, silk, net, transparent material or other desired materials.

In one or more embodiments, various adjusting means are employed on the shoulder, halter and back straps, so that the lengths of the straps may be adjusted as required. In one or more embodiments, detachable securing means may be any means that can be easily attached or detached, such as clasps, hooks, eyes, buttons, loops, openings snaps, rings and other fasteners and are used to allow either the shoulder straps to be fastened to the cups and the sides, if used, or one of the straps be fastened to each cup for a halter-neck design if desired. In one or more embodiments, a length adjusting means may be any means that allows for the adjustment of the length of the straps, such as a sliding or adjustable ring or bracket.

In one or more embodiments, the bra straps and band may also be secured using securing tabs (e.g., via any way now known or later developed such as adhesive, tape, hooks and eyes, hook and loop, etc.). In one or more embodiments, only one shoulder strap can be removed or detached for a one shoulder backless configuration. In this embodiment, the bra includes one detachable shoulder strap, wherein one end of the detachable strap is connected to a top edge of one form-shaping cup and the other end is connected to a top edge of the corresponding side portion or the opposite side portion, to form a one shoulder-strap/backless configuration. It should be noted that any part of the bra of the present invention may be made of a suitable transparent material.

In one or more embodiments, the material used to form the bra or portions thereof, may comprise knitted or woven materials that exhibit a degree of stretch so as to allow the bra to be easily donned and doffed by, for instance, pulling the bra over the wearer's head. For instance, the material may exhibit between 7 N to 8 N at 40% stretch using standard modulus of elasticity tests. In one or more embodiments, the material may exhibit moisture-management characteristics (i.e., the ability of a fabric to transport moisture from a first surface of the fabric to a second surface of the fabric). In one or more embodiments, the material may comprise 80% polyester/20% spandex, 85% polyester/15% spandex, 88% polyester/12% spandex, 90% polyester/10% spandex, or materials having ratios of polyester and spandex between these values or above and below these values.

In one or more embodiments, the bra may have preconfigured lockout and stretch zones, where the amount of lockout or stretch associated with each zone depends on knit and/or woven features, such as specific stitches or construction techniques that modify the stretch properties of each zone. For example, aspects herein relate to a bra formed from a unitary panel of knitted or woven material and having preconfigured lockout and stretch zones with different stretch properties. In one or more embodiments, multiple lockout and stretch zones may be formed in, and spaced adjacently across, the unitary panel. In one or more embodiments, the bra is cut (e.g., stamped, extracted, separated, and/or removed) from the unitary panel such that different regions of the bra are formed from different zones of the unitary panel, in accordance with some aspects. For example, it may be desirable for bust and back regions of the bra to provide compression on a wearer while permitting stretch when the bra is in the as-worn configuration and may therefore be cut from the stretch zones of the unitary panel. It may not be desirable for the chest band and shoulder strap regions of the bra to stretch as much as the bust and back regions, and may therefore be cut from lockout zones of the unitary panel. In one or more embodiments, forming the bra from a unitary panel of knitted or woven material may reduce the number of bonding or seaming points and material waste. In some aspects, the bra has two seams along its sides while still providing lockout and stretch zones in the different regions, as provided in greater detail hereinafter.

In one or more embodiments, the different stretch properties of the zones may be achieved by adjusting one or more knitting or weaving structures, stitch patterns, weaving techniques, and/or yarn selections throughout the manufacture of the knit or woven bra front, with at least one common feature between adjacent zones (i.e., at least one "unitary" element between different zones having different lockout/stretch characteristics). For example, a lockout zone may include a particular knit stitch and yarn selection, and upon transition to an adjacent stretch zone, the particular knit stitch may continue while the selected yarn is changed to a stretch yarn. In this example, a seamless material structure is maintained, with adjacent, knitted zones having different lockout properties and at least one common feature (i.e., the particular knit stitch). In another example, a lockout zone may include a particular lockout stitch construction that transitions to a different stretch stitch construction in stretch zone, while maintaining at least one common yarn between the adjacent zones. In yet another example, the common feature between adjacent zones may be one or more of a consistent warp yarn and a consistent weft yarn extending across the adjacent zones. As used herein, a "common feature" refers to a consistent element used across the knitted or woven material, including at least a portion of at least two different zones, as illustrated by the above examples.

In further aspects, the different stretch properties of the zones may be achieved by varying the knit or woven structures within the zones, such as a knit structure or woven structure constructed to provide lockout within the knit or woven material. For example, a knit structure may be varied within the zones to achieve different stretch properties between the zones. Additionally, different stretch properties of the zones may be achieved by varying the yarn type within and/or between the zones, such as alternating between yarns in particular locations based on the modulus of elasticity of those yarns. A "yarn type" refers to a material content, strand number (e.g., a doubled strand), material formation (e.g. ply, twist), and/or gauge (e.g., denier, tex, diameter, etc.) of a particular yarn, such as a fine-gauge polyester yarn or a bulky-gauge nylon yarn. In one example, a yarn type in a particular bra region may correspond to a particular function within the bra structure, such as a specific yarn type knitted or woven within at least a portion of the stretch zone B to provide a particular support level, material feel, and/or appearance within the cup region of the bra. In some aspects, a yarn type utilized within the stretch zone B may include a lightweight, high-stretch, elastic yarn, or a combination of multiple yarns, that provides resulting material properties with zonal stretch characteristics. Similarly, a different yarn type may be within a different bra region and correspond to a particular function of a different bra structure, such as a specific yarn type knitted or woven within at least a portion of lockout zone A. In some aspects, a yarn type utilized within the lockout zone A may include a heavyweight, low-stretch, non-elastic yarn (i.e., a "hard" yarn), or a combination of multiple yarns, that provides resulting material properties with zonal lockout characteristics.

In one or more embodiments, the overall modulus of elasticity of the knit or woven material may be varied through specific knit stitches or weaving techniques that minimize the elongation of the material fibers in one or more directions (i.e., width-wise, length-wise, or both). The term "elongation" is used to refer to a yarn stretched from a first length to a second length greater than the first length, along the central, longitudinal axis of a yarn. For example, a lockout yarn may be defined as being limited by a maximum amount of elongation, such as a lockout yarn with less than 20% elongation. In another example, a stretch yarn may be defined as stretching within a range of maximum elongation, such as a stretch yarn having a maximum elongation between 50% to 70%. In one aspect, a stretch yarn may be characterized as having a maximum elongation less than 60%. In further aspects, different stretch properties of multiple zones within the bra may correspond to individual yarn placement, integrated knit or woven structures, and/or additional integrated knit or woven aspects used to create lockout in at least one zone and stretch characteristics in an adjacent zone.

In one or more embodiments, the knit or woven bra may be generally characterized as including at least one lockout zone adjacent at least one stretch zone into the material, with the adjacent zones including at least one common feature in a seamless configuration according to some aspects. In one aspect, the bra includes a lockout zone in a strap and chest band region of the bra, and a variable stretch zone in the cup region between the strap and chest band regions. The amount of lockout in the strap and/or chest band region may be adjusted for a desired bra configuration using knit or woven structures, such as specific stitch patterns or weaving techniques utilized within the lockout zones. Further, an amount of lockout may be limited to a single or multiple directions, such as lengthwise lockout in a strap region of a bra, and both lengthwise and widthwise lockout in the chest band region, as discussed in greater detail hereinafter.

In some aspects, a particular yarn inserted in the lockout zones may be knitted or woven to provide a particular characteristic (for example, widthwise lockout) that has a stabilizing effect of minimizing the stretch within the resulting bra and resisting elongation of that lockout zone portion of the bra. In further aspects, the amount of stretch within the stretch zones of the bra may correspond to the features of each zone, such as those using specific knitting or weaving techniques, integrating particular yarn content, and/or including specific support structures or functional features that are knit or woven into the material of the bra. As used herein, a "feature" may include any yarn-related, knitting-related, or weaving-related aspect for manufacturing the bra material. As such, one example of a change between features within the bra material is a change between stretch stitches and lockout stitches. In a further example, a feature may be associated with a change in yarn tension between a stretch zone and a lockout zone of the bra material. In another aspect, the stitch construction within at least a portion of a knit row may provide a particular stitch spacing, stitch length, length of yarn based on the stitch construction, and/or yarn tension that provides at least one feature of at least one stretch or lockout zone within the bra.

In some aspects, a feature of the bra may include one or more variations in knitted or woven construction. For example, a feature of a knit bra may include a short float, a long float, a pillar stitch, a chain stitch, a variable tension between adjacent stitches, a variable tension between adjacent rows of knitting, a knit-in additional yarn, a knitting speed increase, a knitting speed decrease, or a combination of the like. As such, a feature of the bra may include a "lockout stitch" characterized by, for example, a short float, or additional/alternative lockout features that restrict stretch of the material. In another example, a "stretch stitch" may be characterized as including a long float, or additional/alternative stretch features that permit stretch of the material. In further aspects, a lockout stitch, a stretch stitch, a yarn tension, a yarn length, a stitch spacing, a stitch-to-needle ratio, a yarn overlapping, a needle skipping, or additional construction techniques or material effects may be adjusted throughout the material knitting.

In further examples, the amount of stretch within a stretch zone of the bra may be controlled by including a specific, integrated structure at a specific location within the stretch zone. Examples of an integrated structure that is integrally knit or woven into an bra material include an integrated channel structure (e.g., an underwire channel), an integrated pocket structure, an integrated adjustment feature, an integrated strap component, an integrated graphic structure (e.g., yarn change), or other integrated textile element incorporated into the material and having an impact on the stretch modulus of at least a portion of the bra. Such integrated structures may include a jacquard structure knitted or woven into the material, such as a jacquard knit structure that inserts additional or alternative yarns into different locations to form graphics, thereby impacting the material stretch modulus. For example, as discussed in more detail below with respect to FIG. 7, a jacquard structure may be used to insert a different yarn into a different location to form graphic element within the bra, such as a graphic element oriented around the cup and strap zones that affects the overall modulus within each zone. In some aspects, an amount of stretch and corresponding compression/support within a portion of the stretch zone of the bra may be changed using integrated structures, such as a change in stretch based on a channel structure for receiving an underwire and/or a cup pocket for receiving a liner.

Such inserted yarns or integrated structures may be applied throughout an entire row of knitting or weaving, or in other aspects, may be incorporated in a particular portion or multiple discrete portions of a single row, which may be referred to as the "zonal" placement of integrated structures. As such, the varied yarn content and support/functional features may dynamically change in a lateral direction across a row of warp knitting or weaving as well as along the width of the knitted or woven material in a direction normal to the lateral direction. For example, lengthwise yarn changes in the warp direction may provide banded, zonal changes along the y axis of the material while at the same time, widthwise changes in knitted or woven structures may provide for additional, zonal changes in lockout or stretch features along the x axis within the bra material. As such, an integrated structure may be positioned at a preconfigured location with respect to the respective support zones (for example, at a particular location within the weft direction and the warp direction of a material).

In further aspects, the method of manufacturing the knit or woven bra may utilize a particular yarn type across an entire length or entire width of an bra material (based on the knitting or weaving technology used) such that yarn selection corresponds to a series of knit or woven rows in a lockout zone or a series of knit or woven rows in a stretch zone (i.e., a band of yarn content, lengthwise or widthwise). In addition to the banded yarn content, zonal changes in integrated knit or woven structures may alter the zonal stretch and/or zonal lockout characteristics within each lockout zone and each stretch zone. For example, a stretch zone having a stretch yarn carried across the entire width of the material may have a particular stretch characteristic spanning the width of the stretch zone, as derived from yarn characteristics (i.e., the "feature" being stretch yarn selection), while at the same time having particular stretch characteristics in zonal locations associated with integrated structures. In other words, while the stretch yarn may continue across the stretch zone, the additional characteristics provided by integrated knit or woven structures may impact a portion of the bra in the particular stretch zone. In yet another example, the lockout yarn used to generate lockout in a particular lockout zone (i.e., the "feature" of lockout yarn selection), as carried across an entire lockout zone, may further provide additional lockout characteristics that correspond to particular integrated knit or woven structures impacting a portion of the lockout zone.

Accordingly, one or more zonal stretch characteristics corresponding to yarn type and/or integrated structure placement may correspond to a particular function of a particular part of the bra (e.g., a stretch zone within a bra cup region may include enhanced stretch based on integrated structures knitted or woven at particular positions), while maintaining a common stretch yarn content across the width of the bra (i.e., even though a portion of the stretch zone may include integrated structures. For example, a same yarn may be knitted or woven throughout an entire lockout zone, with a change in stitch construction or weaving technique that alters the lockout properties of a portion of that particular zone. Similarly, a same yarn may be knitted or woven throughout an entire stretch zone, with a change in stitch construction or weaving technique that alters the stretch properties of a portion of that particular zone. As used here, a zonal or organic placement of an integrated structure refers to an integrated structure knitted or woven in a particular portion of the material, such as a zonal integrated structure providing a specific function at a particular location without spanning the entire width of the knit or woven material.

It is contemplated that the constructions of the bra of the present invention may use any combination of nylon, cotton, spandex or any other suitable material and have any manner of lace, color or aesthetic design in its manufacturing. The detachable straps are secured by any suitable manner, including means of small metal or plastic hooks, fabric loops or snaps in its manufacturing. Additionally, various other adjustable constructions for use with various types of apparel such as sportswear, swimwear, evening gowns and formal wear, and casual wear including strapless, backless, one shoulder, and/or halter type designs or other convertible bra designs are also contemplated. Thus, although particular embodiments of the present invention of a new and useful convertible bra have been described, it is not intended that such references be construed as limitation upon the scope of this invention, except as set forth in the following claims.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A configurable bra comprising:

a left breast cup and a right breast cup and configured to constrain a lower side of a left human breast, a lower side of a right human breast, an outer side of a left human breast, and an outer side of a right human breast;

a bra band attachable to the left breast cup and the right breast cup and configured to be positionable around a torso of a woman;

a base layer that is attached between left side and a right side of the left breast cup and the right breast cup, configured to be situated over a left shoulder and a right shoulder of the torso of the woman, and configured to attach to a back portion of the configurable bra; and an adjustable lifting structure that overlies the base layer and configured to adjustably attach to a portion of the left breast cup and the right breast cup at both shoulders; wherein the adjustable lifting structure adjusts tension and vertical support to the left and right breast cups, wherein the adjustable lifting structure comprises a vertically adjustable underwire that is guided through a looped channel that passes through a left strap, under both left and right breast cups, and back up a right strap, and wherein one or more ends of the vertically adjustable underwire exit from the bra band for adjustment to change tension and vertical support to left breast cup and right breast cup, thereby the adjustment is specific to one of the left breast cup and right breast cup.

2. The configurable bra of claim 1, wherein the adjustable lifting structure adjusts tension and vertical support to the left breast cup and right breast cups independently.

* * * * *